US008973483B2

(12) United States Patent
Sullivan

(10) Patent No.: US 8,973,483 B2
(45) Date of Patent: Mar. 10, 2015

(54) GAS REGULATOR SYSTEM

(71) Applicant: ArmWest, LLC, Prescott, AZ (US)

(72) Inventor: Leroy James Sullivan, Prescott, AZ (US)

(73) Assignee: Arm West, LLC, Prescott, AZ (US)

( * ) Notice: Subject to any disclaimer, the term of this patent is extended or adjusted under 35 U.S.C. 154(b) by 0 days.

(21) Appl. No.: 13/829,464

(22) Filed: Mar. 14, 2013

(65) Prior Publication Data

US 2013/0269510 A1 Oct. 17, 2013

Related U.S. Application Data

(63) Continuation-in-part of application No. 13/350,156, filed on Jan. 13, 2012, and a continuation-in-part of application No. 13/348,871, filed on Jan. 12, 2012, and a continuation-in-part of application No. 13/071,990, (Continued)

(51) Int. Cl.
*F41A 5/28* (2006.01)
*F41A 3/26* (2006.01)
(Continued)

(52) U.S. Cl.
CPC ... *F41A 5/28* (2013.01); *F41A 3/26* (2013.01); *F41A 3/64* (2013.01); *F41A 3/66* (2013.01); *F41A 3/70* (2013.01); *F41A 3/72* (2013.01); *F41A 3/84* (2013.01); *F41A 5/18* (2013.01); *F41A 5/24* (2013.01); *F41A 5/26* (2013.01); *F41A 11/00* (2013.01); *F41A 11/04* (2013.01); *F41A 15/14* (2013.01); *F41A 17/00* (2013.01); *F41A 17/30* (2013.01); *F41A 17/64* (2013.01);

(Continued)

(58) Field of Classification Search
CPC ..... F41A 5/18; F41A 5/26; F41A 5/28
USPC ..... 89/129.01, 191.01, 193
See application file for complete search history.

(56) References Cited

U.S. PATENT DOCUMENTS 804,986 A 11/1905 Stamm
980,980 A 1/1911 Maggio
(Continued)

FOREIGN PATENT DOCUMENTS

CH 37247 5/1907
CH 199224 8/1938
(Continued)

OTHER PUBLICATIONS

Anonymous: "Magazine Feed Liptool," Internet Article, http://www.brownells.com/.aspx/pid=25049/Product/Magazine-Feed-Liptool, Retrieved from the Internet on Jul. 3, 2012.

*Primary Examiner* — Bret Hayes
(74) *Attorney, Agent, or Firm* — Haynes and Boone, LLP

(57) ABSTRACT

A gas regulator block can be configured to mount to a barrel of a firearm. A gas regulator can be disposed substantially within the gas regulator block and can be configured to adjustably vary an amount of gas flow through the gas regulator block. A cover may be configured to cover a portion of the gas regulator block to inhibit inadvertent adjustment of the amount of gas flow and configured to uncover the portion of the gas regulator block to facilitate intentional adjustment of the amount of gas flow. A gas passage can be formed in the gas regulator block in a forward location and the gas port can be configured to communicate gas from the barrel to the gas regulator.

27 Claims, 32 Drawing Sheets

Related U.S. Application Data filed on Mar. 25, 2011, now Pat. No. 8,739,446.

(60) Provisional application No. 61/678,976, filed on Aug. 2, 2012, provisional application No. 61/433,115, filed on Jan. 14, 2011, provisional application No. 61/524,138, filed on Aug. 16, 2011, provisional application No. 61/433,092, filed on Jan. 14, 2011, provisional application No. 61/433,083, filed on Jan. 14, 2011, provisional application No. 61/478,439, filed on Apr. 22, 2011, provisional application No. 61/479,194, filed on Apr. 26, 2011, provisional application No. 61/498,426, filed on Jun. 17, 2011, provisional application No. 61/528,062, filed on Aug. 26, 2011, provisional application No. 61/317,396, filed on Mar. 25, 2010.

(51) Int. Cl.

| | |
|---|---|
| ***F41A 3/64*** | (2006.01) |
| ***F41A 3/66*** | (2006.01) |
| ***F41A 3/70*** | (2006.01) |
| ***F41A 3/72*** | (2006.01) |
| ***F41A 3/84*** | (2006.01) |
| ***F41A 5/18*** | (2006.01) |
| ***F41A 5/24*** | (2006.01) |
| ***F41A 5/26*** | (2006.01) |
| ***F41A 11/00*** | (2006.01) |
| ***F41A 11/04*** | (2006.01) |
| ***F41A 15/14*** | (2006.01) |
| ***F41A 17/00*** | (2006.01) |
| ***F41A 17/30*** | (2006.01) |
| ***F41A 17/64*** | (2006.01) |
| ***F41A 19/10*** | (2006.01) |
| ***F41A 19/13*** | (2006.01) |
| ***F41A 19/42*** | (2006.01) |
| ***F41A 19/43*** | (2006.01) |
| ***F41A 19/46*** | (2006.01) |
| ***F41A 21/48*** | (2006.01) |
| ***F41A 35/02*** | (2006.01) |
| ***F41C 23/04*** | (2006.01) |
| ***F41C 23/20*** | (2006.01) |

(52) U.S. Cl.

CPC ..... *F41A 19/10* (2013.01); *F41A 19/13* (2013.01); *F41A 19/42* (2013.01); *F41A 19/43* (2013.01); *F41A 19/46* (2013.01); *F41A 21/48* (2013.01); *F41A 21/484* (2013.01); *F41A 35/02* (2013.01); *F41C 23/04* (2013.01); *F41C 23/20* (2013.01)

USPC ..... 89/193

(56) References Cited

U.S. PATENT DOCUMENTS

| | | | | |
|---|---|---|---|---|
| 1,202,707 | A | | 10/1916 | Greico |
| 1,227,439 | A | | 5/1917 | Hilgendorf |
| 1,402,459 | A | | 1/1922 | Gustaf |
| 1,413,409 | A | | 4/1922 | Lackman |
| 1,476,657 | A | | 12/1923 | Tawney |
| 1,500,580 | A | | 7/1924 | Matteo |
| 1,588,887 | A | | 6/1926 | Haubroe |
| 1,907,164 | A | | 5/1933 | White |
| 1,946,388 | A | | 2/1934 | Chevallier |
| 2,088,268 | A | | 7/1937 | Lauf |
| 2,096,028 | A | | 10/1937 | Burton et al. |
| 2,147,208 | A | | 2/1939 | Nolan |
| 2,217,848 | A | | 10/1940 | Schillstrom |
| 2,345,031 | A | | 3/1944 | Carithers |
| 2,365,306 | A | | 12/1944 | Swebilius |
| 2,365,392 | A | | 12/1944 | Cooley |
| 2,376,466 | A | | 5/1945 | Williams |
| 2,391,756 | A | | 12/1945 | Vesely |
| 2,462,119 | A | | 2/1949 | Moore |
| 2,482,880 | A | | 9/1949 | Sefried, II |
| 2,488,233 | A | | 11/1949 | Pelo |
| 2,503,116 | A | | 4/1950 | Maillard |
| 2,756,640 | A | | 7/1956 | Maillard |
| 2,791,944 | A | * | 5/1957 | Harvey ..... 89/193 |
| 2,910,332 | A | | 10/1959 | Madsen |
| 2,981,154 | A | | 4/1961 | Sweeney |
| 3,043,198 | A | | 7/1962 | Burns et al. |
| 3,090,148 | A | | 5/1963 | Smith |
| 3,090,149 | A | | 5/1963 | Merles |
| 3,198,076 | A | | 8/1965 | Stoner |
| 3,226,869 | A | | 1/1966 | Musgrave |
| 3,318,192 | A | | 5/1967 | Sullivan et al. |
| 3,330,183 | A | | 7/1967 | Löffler |
| 3,333,510 | A | | 8/1967 | Muhlemann |
| 3,345,771 | A | | 10/1967 | Silsby |
| 3,346,982 | A | | 10/1967 | Loffler et al. |
| 3,366,011 | A | | 1/1968 | Stutervant |
| 3,440,751 | A | | 4/1969 | Fremont |
| 3,604,142 | A | | 9/1971 | Silsby |
| 3,672,089 | A | | 6/1972 | Silsby |
| 3,688,641 | A | | 9/1972 | Curtis et al. |
| 3,795,173 | A | | 3/1974 | Freymond |
| 3,977,114 | A | | 8/1976 | Poor |
| 3,990,348 | A | | 11/1976 | Vesamaa |
| 4,020,740 | A | | 5/1977 | Schirneker |
| 4,127,954 | A | | 12/1978 | Hausmann |
| 4,416,186 | A | | 11/1983 | Sullivan |
| 4,428,137 | A | | 1/1984 | Johnson |
| 4,433,611 | A | * | 2/1984 | Baumann ..... 89/193 |
| 4,446,645 | A | | 5/1984 | Kelsey, Jr. |
| 4,505,182 | A | | 3/1985 | Sullivan |
| 4,524,672 | A | | 6/1985 | Balsavage |
| 4,589,218 | A | | 5/1986 | Teppa |
| 4,765,224 | A | | 8/1988 | Morris |
| 5,168,648 | A | | 12/1992 | Brandl |
| 5,448,940 | A | | 9/1995 | Schuetz et al. |
| 5,495,687 | A | | 3/1996 | Waiser |
| 5,561,933 | A | | 10/1996 | Czekalski |
| 5,634,288 | A | | 6/1997 | Martel |
| 5,827,992 | A | | 10/1998 | Harris et al. |
| 5,909,002 | A | | 6/1999 | Atchisson |
| 6,340,161 | B1 | | 1/2002 | Zitting et al. |
| 6,484,430 | B1 | | 11/2002 | Robinson et al. |
| 6,722,255 | B2 | | 4/2004 | Herring |
| 6,829,974 | B1 | | 12/2004 | Gwinn, Jr. |
| 6,848,351 | B1 | | 2/2005 | Davies |
| 6,898,888 | B2 | | 5/2005 | Greenhut |
| 7,117,626 | B1 | | 10/2006 | Alzamora |
| 7,293,385 | B2 | | 11/2007 | McCormick |
| 7,627,974 | B2 | | 12/2009 | Olson |
| 7,823,314 | B1 | | 11/2010 | Wheatley |
| 7,832,326 | B1 | | 11/2010 | Barrett |
| 7,886,470 | B1 | | 2/2011 | Doiron |
| 7,938,055 | B2 | | 5/2011 | Hochstrate et al. |
| 8,061,071 | B2 | | 11/2011 | Fitzpatrick et al. |
| 8,087,194 | B1 | | 1/2012 | Vuksanovich |
| 8,141,285 | B2 | | 3/2012 | Brown |
| 8,205,373 | B1 | | 6/2012 | Ubl et al. |
| 8,210,089 | B2 | | 7/2012 | Brown |
| 8,261,653 | B2 | | 9/2012 | Crommett |
| 8,316,756 | B1 | | 11/2012 | Woodell et al. |
| 8,365,454 | B2 | | 2/2013 | Hogan, Jr. |
| 2003/0188567 | A1 | | 10/2003 | Garrett |
| 2005/0262752 | A1 | | 12/2005 | Robinson et al. |
| 2008/0092733 | A1 | | 4/2008 | Leitner-Wise et al. |
| 2008/0134557 | A1 | | 6/2008 | Wossner et al. |
| 2010/0095833 | A1 | | 4/2010 | Gavage et al. |
| 2010/0126053 | A1 | | 5/2010 | Fitzpatrick et al. |
| 2010/0163250 | A1 | | 7/2010 | Schultz et al. |
| 2010/0186582 | A1 | * | 7/2010 | Juarez ..... 89/191.01 |
| 2010/0269389 | A1 | | 10/2010 | Lopez Laparra |
| 2010/0275770 | A1 | * | 11/2010 | Noveske ..... 89/193 |
| 2011/0005384 | A1 | | 1/2011 | Lewis et al. |

(56) References Cited

U.S. PATENT DOCUMENTS

| | | | | |
|---|---|---|---|---|
| 2011/0023699 | A1* | 2/2011 | Barrett | 89/193 |
| 2011/0173857 | A1 | 7/2011 | Hogan, Jr. | |
| 2012/0131831 | A1 | 5/2012 | Sullivan et al. | |
| 2012/0152105 | A1 | 6/2012 | Gomez et al. | |
| 2013/0098235 | A1* | 4/2013 | Reinken | 89/193 |

FOREIGN PATENT DOCUMENTS

| | | | | |
|---|---|---|---|---|
| DE | 569280 | | 2/1933 | |
| DE | 203574 | | 8/1938 | |
| DE | 664926 | | 9/1938 | |
| DE | 712084 | | 10/1941 | |
| DE | 858944 | | 12/1952 | |
| DE | 3707925 | | 9/1988 | |
| DE | 4136665 | A1 * | 5/1993 | F41A 5/02 |
| DE | 102006011278 | | 9/2007 | |
| DE | 102007011502 | | 9/2008 | |
| DE | 10 2007 034670 | | 1/2009 | |
| EP | 0055690 | | 7/1982 | |
| EP | 1479997 | | 11/2004 | |
| EP | 1596151 | | 11/2005 | |
| EP | 2045561 | | 4/2009 | |
| FR | 1362361 | | 5/1964 | |
| GB | 166579 | | 7/1921 | |
| GB | 525429 | | 8/1940 | |
| GB | 536728 | | 12/1944 | |
| GB | 604348 | | 7/1948 | |
| GB | 1227706 | | 4/1971 | |
| GB | 1338189 | | 11/1973 | |
| GB | 2231943 | | 11/1990 | |
| JP | 2003/287127 | | 10/2003 | |
| WO | WO 97/25581 | | 7/1997 | |

* cited by examiner

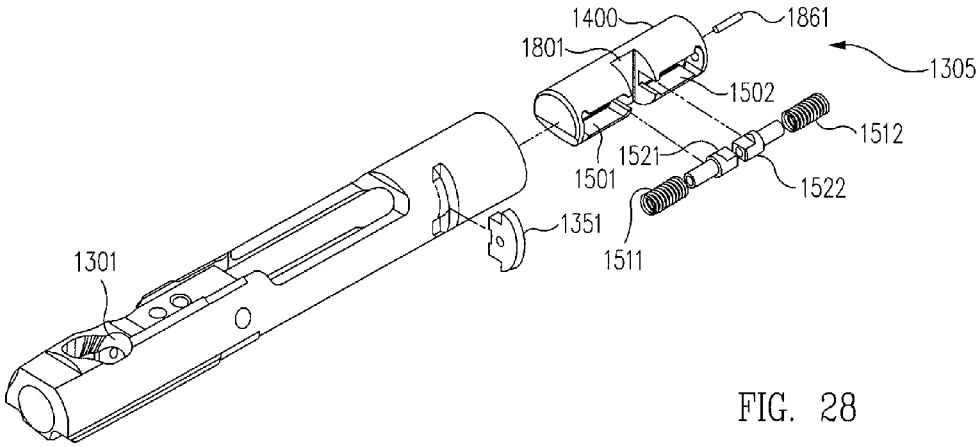
FIG. 28
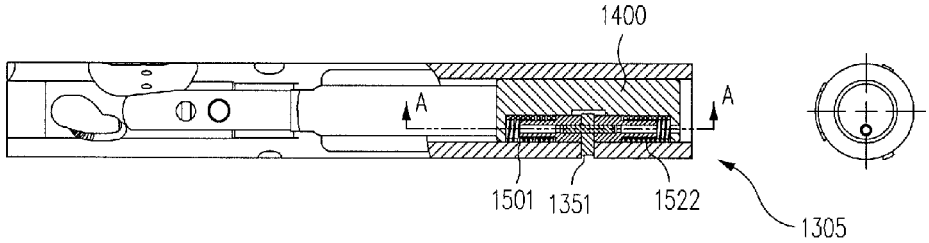
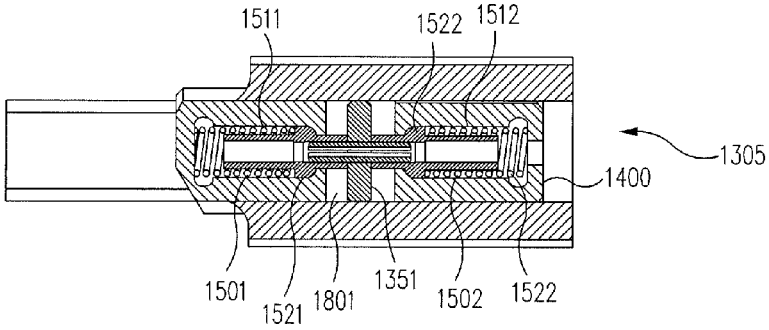

GAS REGULATOR SYSTEM

CROSS-REFERENCE TO RELATED APPLICATIONS

This application claims the benefit of U.S. Provisional Patent Application No. 61/678,976 filed Aug. 2, 2012 which is hereby incorporated by reference in its entirety.

This application is a continuation-in-part of U.S. patent application Ser. No. 13/350,156 filed Jan. 13, 2012 which is hereby incorporated by reference in its entirety.

U.S. patent application Ser. No. 13/350,156 claims the benefit of U.S. Provisional Patent Application No. 61/433,115 filed Jan. 14, 2011 which is hereby incorporated by reference in its entirety.

U.S. patent application Ser. No. 13/350,156 claims the benefit of U.S. Provisional Patent Application No. 61/524,138 filed Aug. 16, 2011 which is hereby incorporated by reference in its entirety.

This application is a continuation-in-part of U.S. patent application Ser. No. 13/348,871 filed Jan. 12, 2012 which is hereby incorporated by reference in its entirety.

U.S. patent application Ser. No. 13/348,871 claims the benefit of U.S. Provisional Patent Application No. 61/433,092 filed Jan. 14, 2011 which is hereby incorporated by reference in its entirety.

U.S. patent application Ser. No. 13/348,871 claims the benefit of U.S. Provisional Patent Application No. 61/433,083 filed Jan. 14, 2011 which is hereby incorporated by reference in its entirety.

U.S. patent application Ser. No. 13/348,871 claims the benefit of U.S. Provisional Patent Application No. 61/478,439 filed Apr. 22, 2011 which is hereby incorporated by reference in its entirety.

U.S. patent application Ser. No. 13/348,871 claims the benefit of U.S. Provisional Patent Application No. 61/479,194, filed Apr. 26, 2011 which is hereby incorporated by reference in its entirety.

U.S. patent application Ser. No. 13/348,871 claims the benefit of U.S. Provisional Patent Application No. 61/498,426, filed Jun. 17, 2011 which is hereby incorporated by reference in its entirety.

U.S. patent application Ser. No. 13/348,871 claims the benefit of U.S. Provisional Patent Application No. 61/528,062 filed Aug. 26, 2011 which is hereby incorporated by reference in its entirety.

This application is a continuation-in-part of U.S. patent application Ser. No. 13/071,990 filed Mar. 25, 2011, which claims the benefit of U.S. Provisional Patent Application No. 61/317,396 filed Mar. 25, 2010, all of which are hereby incorporated by reference in their entirety.

TECHNICAL FIELD

The present invention relates generally to firearms. The present invention relates more particularly, for example, to methods and systems for increasing the durability and reliability of a firearm, such as to better support sustained fully automatic fire.

BACKGROUND

Gas operated firearms are well known. Gas operated firearms use some of the gas from a cartridge being fired to extract the spent case of the cartridge and to chamber a new cartridge. The gas travels from a port in the barrel to a gas cylinder where the gas pushes a piston within the gas cylinder to operate a mechanism for extracting the spent case and for chambering the new cartridge. In some firearms, such as the M16 and the M4, the gas cylinder is formed in the bolt carrier and the piston is part of the bolt. In such firearms, gas is provided from the barrel to the gas cylinder by a gas tube.

In other firearms, such as the HK416, a separate (not part of the bolt) piston is used. The piston is disposed in a gas cylinder that is not part of the bolt carrier. This separate piston applies force through a tappet or operating rod and a bolt carrier to operate the mechanism for extracting the spent case and for chambering the new cartridge.

Whether or not the piston is part of the bolt, it is desirable to prevent gas leakage between the piston and the cylinder. Contemporary gas operated firearms commonly use a plurality of piston rings which fit into a groove of the piston and provide a gas seal between the piston and the cylinder to mitigate gas leakage. For example, the M16, M4, and HK416 use three rings. Each of the rings is a split ring that has a gap formed therein to facilitate installation of the ring and to apply an outward spring force that tends to seal the loose fit between the piston and the cylinder.

Contemporary rings possess inherent deficiencies which detract from their overall effectiveness and desirability. For example, the gaps of the three rings occasionally line up in a manner that allows hot gasses to flow readily through the gaps and thereby undesirably bypass the rings. Contemporary gas tubes also possess inherent deficiencies which detract from their effectiveness and desirability. For example, contemporary gas tubes can overheat and lose strength, particularly during sustained fully automatic fire of the firearm.

The higher level of heat associated with sustained fully automatic fire can result in undesirable thermal expansion of the gas tube both radially and longitudinally. Such thermal expansion can be substantially beyond an amount accommodated by the available space in the firearm. Such thermal expansion can result in sliding/clearance fits becoming interference fits. That is, a sliding fit can undesirably become a non-sliding fit. When the gas tube heats up excessively, the weakened and expanded gas tube can bend and be damaged, thus causing the firearm to become inoperative. As such, it is desirable to provide methods and systems for mitigating overheating in gas operated firearms.

Forward and rearward bouncing of the bolt carrier can cause the cyclic rate of a firearm to increase substantially. This increase in the cyclic rate can reduce the reliability of the firearm and can increase wear on the firearm, as discussed herein. As such, it is desirable to provide methods and systems for mitigating both forward and rearward bouncing of the bolt carrier.

The gas port of a contemporary M16/M4 firearm is subject to erosion caused by bullet scrubbing and propellant bombardment. Such erosion results in enlargement of the gas port and consequently an undesirable increase in the cyclic rate of the firearm over time. This undesirable increase in the cyclic rate can eventually result in malfunction and damage to the firearm. As such, it is desirable to provide for the metering of gas in a manner that does not result in an increased cyclic rate over time.

BRIEF SUMMARY

In accordance with embodiments further described herein, methods and systems are provided for enhancing the reliability of a gas operated firearm, such as a fully automatic gas operated firearm. For example, the gas port of a firearm can be moved forward along the barrel so as to delay the time at which gas acts upon the bolt of the firearm after a cartridge is fired and so as to reduce the pressure of the gas. In this manner, the cyclic rate of the firearm can be reduced and the reliability of the firearm can be enhanced.

According to an embodiment, a device can comprise a front sight block for a firearm, a rear band and a front band for attaching the sight block to a barrel of the firearm, and a gas passage formed in either band for facilitating gas flow from the barrel to a gas tube of the firearm. The gas passage can be substantially more forward along the barrel where gas pressure is substantially lower than it would be if formed in the rear band.

According to an embodiment, a firearm can comprise a barrel having a gas port, a gas tube and a front sight block for a firearm. The front sight block can have a rear band and a front band for attaching the sight block to the barrel. A gas passage can be formed in the rear band for the long barrel of a rifle and in the front band for the short barrel of a carbine to more nearly match the same operating gas pressure in both firearms.

According to an embodiment, a method for making a firearm can comprise forming a gas passage in a front band of a front sight block and forming a gas port in a barrel. The front sight block can be attached to the barrel such that the gas passage is substantially aligned with respect to the gas port.

According to an embodiment, a method for operating a firearm can comprise flowing gas from a barrel of the firearm through a front band of a front sight block and to a gas tube. In this manner, the reliability of the firearm can be substantially enhanced.

According to an embodiment, a gas regulator block can be configured to mount to a barrel of a firearm. A gas regulator can be disposed substantially within the gas regulator block and can be configured to adjustably vary an amount of gas flow through the gas regulator block. A cover can be configured to cover a portion of the gas regulator block to inhibit inadvertent excessive adjustment of the amount of gas flow and can be configured to uncover the gas regulator screw so it can be removed from the gas regulator block. A gas passage can be formed in the gas regulator block and the gas passage can be configured to communicate gas from the barrel to the gas regulator.

According to an embodiment, a system can comprise a firearm having a barrel with a gas port formed therein. A gas regulator block can be mounted to the barrel. A gas regulator can be disposed substantially within the gas regulator block and can be configured to vary an amount of gas flow through the gas regulator block. A cover can be configured to cover a portion of the gas regulator block to inhibit excessive adjustment of the amount of gas flow and can be configured to uncover the portion of the gas regulator block to facilitate removal of the gas regulator screw. A gas passage can be formed in the gas regulator block. The gas passage can be configured to communicate gas from the gas passage to the gas regulator.

According to an embodiment, a method can comprise rotating a cover attached to a gas regulator block of a firearm to substantially expose an adjustment screw. The method can further comprise turning the adjustment screw to vary an amount of gas used to cycle the firearm. A spring can urge a plunger into troughs of the adjustment screw to index the adjustment screw as the adjustment screw is turned.

The scope of the disclosure is defined by the claims, which are incorporated into this section by reference. A more complete understanding of embodiments will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

FIG. 28 includes various views of an anti-bounce assembly, according to an embodiment.

Embodiments of the present invention and their advantages are best understood by referring to the detailed description that follows. It should be appreciated that like reference numerals are used to identify like elements illustrated in one or more of the figures.

DETAILED DESCRIPTION

As examples, methods and systems for inhibiting undesirable gas leakage and/or heat build up in a gas operated firearm are disclosed. For example, a pair of rings can be configured to interlock with respect to one another such that the rings rotate within a groove of a piston of a gas system of a firearm. Since the rings rotate in unison, they do not align in a manner that readily facilitates undesirably increased gas flow past the piston. Such rings can generally be used with both M16/M4 and HK416 types of firearms.

As a further example, a gas tube that better tolerates the heat associated with sustained fully automatic fire of a firearm is disclosed. The gas tube is less prone to overheating and better accommodates thermal expansion. Thus, the firearm cycles and fires more uniformly and is more reliable. Such a gas tube can generally be used with M16/M4 types of firearms and generally cannot be used with HK416 types of firearms since HK416 types of firearms use a substantially different gas system.

As a further example, methods and systems are provided for inhibiting undesirable forward and rearward bouncing of a bolt carrier of a gas operated firearm, such as a fully automatic gas operated firearm. An anti-bounce assembly can mitigate undesirable speeding up of the cyclic rate of a firearm due to gas port erosion and can thus reduce wear and increase the reliability of the firearm.

According to an embodiment, the beginning of the gas passage and the barrel gas port can be positioned in the forward ring of a two ring gas regulator block. Forward positioning of the barrel gas port allows a central positioning of the gas regulator screw, surrounding it, and the gas passageway between the gas port and screw with an increased amount of material that is the gas regulator block and the increased amount of material acts as a heat sink, absorbing heat that might otherwise damage the device.

According to an embodiment, an adjusting screw can comprise a stem and threads. At least one cutting groove can be formed at an inward end of the threads where the threads join the stem such that the cutting grooves are configured to remove, cut, and/or break up any carbon deposits that may have accumulated in a cavity between an end of the threads and the stem hole in the gas regulator block or in tube configured to extend from the gas regulator block to a bolt carrier assembly of the firearm, such cutting occurring when the screw is adjusted for removal.

Examples of embodiments of keyed gas piston rings and pistons/bolts are discussed in detail below. Examples that are suitable for use with the M16/M4 rifle are discussed with reference to FIGS. 1-3 and 7. Examples that are suitable for use with the HK416 rifle are discussed with reference to FIGS. 4-6 and 8. Examples of embodiments of more heat tolerant and/or heat dissipating gas tubes are also discussed in detail below. Examples of such enhanced gas tubes are discussed with reference to FIGS. 9-12.

Figure 1:
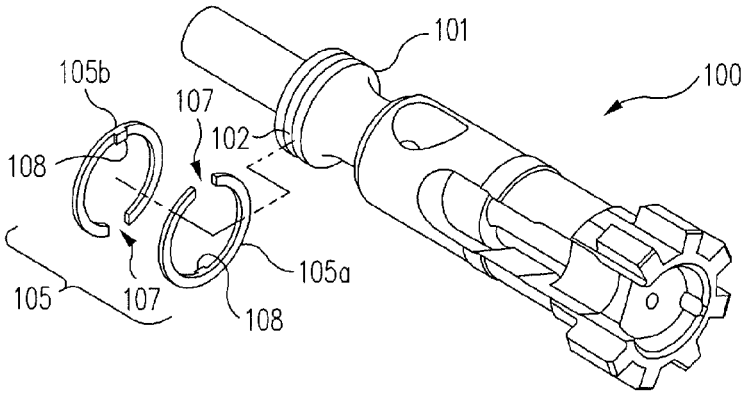
FIG. 1 is a perspective view of a bolt showing keyed piston rings exploded therefrom, according to an embodiment.
Figure 2:
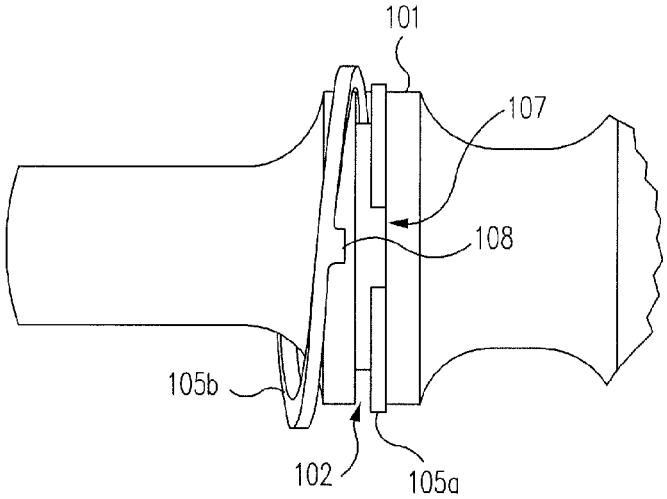
FIG. 2 is an enlarged side view of a piston of FIG. 1 having one keyed piston ring installed thereon and one keyed piston ring partially installed thereon, according to an embodiment.
Figure 3:
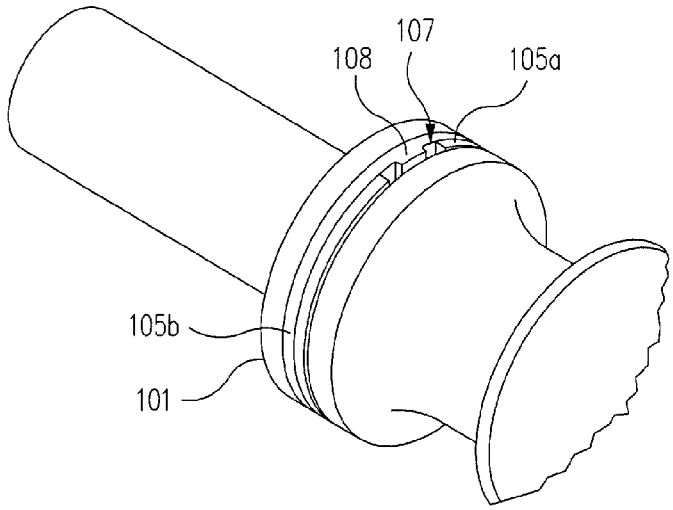
FIG. 3 is an enlarged perspective view of the piston of FIG. 1 having two keyed piston rings installed thereon, according to an embodiment.

The gas piston of the M16 or M4 is an integrated part of the bolt and a gas cylinder is formed in the bolt carrier. The gas cylinder, i.e., the bolt carrier, moves with respect to the gas piston. FIGS. 1-3 show a system for inhibiting undesirable gas flow around such a piston and are discussed in detail below.

FIG. 1 is a perspective view of a bolt 100 of a gas operated firearm 700 (see FIG. 7), according to an embodiment. The bolt 100 can be a bolt of an M16 rifle, for example. The bolt 100 can have a piston 101 formed thereon. A groove 102 can be formed circumferentially around the piston 101. A pair of rings 105 are shown exploded from the bolt 100. The rings 105 can comprise a first ring 105*a* and a second ring 105*b*. The rings 105 can be configured to be received at least partially within the groove 102 of the piston 101 of the gas operated firearm 700.

A key 108 can be formed upon each of the rings 105. The key 108 can extend generally perpendicularly with respect to a plane of the rings 105. The key 108 can have a generally rectangular cross-section when taken in either of two generally orthogonal planes.

A gap 107 can be formed in each of the rings 105. The gap 107 of each one of the rings 105 can be configured to receive at least a portion of the key 108 of another one of the rings 105. The gap 107 can have a generally rectangular cross-section when taken in either of two generally orthogonal planes. Thus, a pair of the rings 105 can be configured to interlock with one another such that the two rings 105 can rotate, but can only rotate substantially in unison with respect to one another.

In an embodiment, the key 108 and the gap 107 of each ring 105 can be formed such that a pair of the rings 105 are nestable with the key 108 of each of the rings 105 being disposed within the gap 107 of each other of the rings 105 while the rings 105 are substantially flush with respect to one another. The nesting of the rings 105 interlocks the rings 105 such that the rings 105 rotate in unison.

In an embodiment, the gaps 107 of the two rings 105 can be diametrically opposed with respect to one another when the rings 105 are interlocked. Since the two rings 105 rotate substantially in unison, the gaps 107 do not align in a fashion that facilitates increased gas flow past the rings 105.

In an embodiment, the rings 105 can be formed of stainless steel. For example, the rings 105 can be formed of 17-4 stainless steel. Various other materials, including refractory materials such as ceramics, are contemplated.

In an embodiment, the groove 102 can be substantially rectangular in cross-section. In such an embodiment, the rings 105 can also be substantially rectangular in cross-section and thus can be generally complementary in size and shape with respect to the groove 102.

FIG. 2 is an enlarged side view of the piston 101 having one ring 105*a* fully installed thereon and having one ring 105*b* partially installed thereon, according to an embodiment. The rings 105 can be temporarily bent or spring deformed in order to slide over the piston 101 and into the groove 102. The key 108 of the second ring 105*b* is positioned to be received at least partially within the gap 107 of the first ring 105*a*.

FIG. 3 is an enlarged perspective view of the piston 101 having two rings 105 installed thereon, according to an embodiment. The two rings 105 are seated within the groove 102. The key 108 of the second ring 105*b* is disposed at least partially within the gap 107 of the first ring 105*a* and the key 108 of the first ring 105*a* is disposed at least partially within the gap 107 of the second ring 105*b*.

Figure 4:
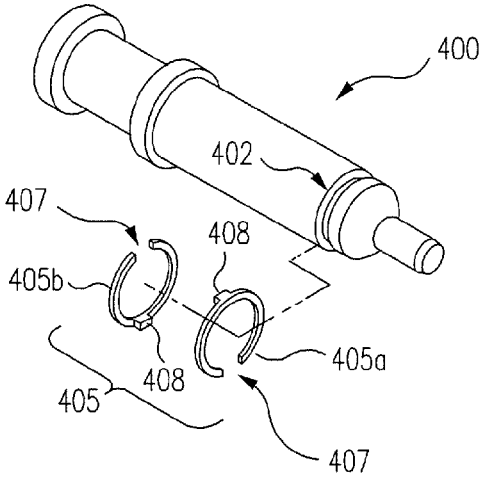
FIG. 4 is a perspective view of a piston showing keyed piston rings exploded therefrom, according to an embodiment.
Figure 5:
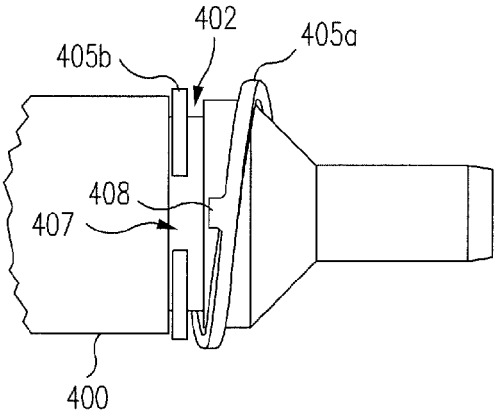
FIG. 5 is an enlarged side view of the piston of FIG. 4 having one keyed piston ring installed thereon and one keyed piston ring partially installed thereon, according to an embodiment.
Figure 6:
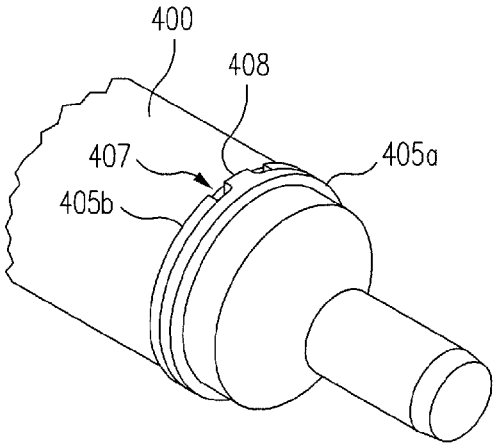
FIG. 6 is an enlarged perspective view of the piston of FIG. 4 having two keyed piston rings installed thereon, according to an embodiment.

A piston 400 of an HK416 is disposed in a gas cylinder 801 of the firearm 800. FIGS. 4-6 show a system for inhibiting undesirable gas flow around the piston 400 and are discussed in detail below.

FIG. 4 is a perspective view of the piston 400 of a gas operated firearm 800 (see FIG. 8), according to an embodiment. The piston 400 can be a piston of an HK416 rifle, for example. A groove 402 can be formed circumferentially around the piston 400. A pair of rings 405 are shown exploded from the piston 400. The rings 405 can comprise a first ring 405*a* and a second ring 405*b*. The rings 405 can be configured to be received at least partially within the groove 402.

A key 408 can be formed upon each of the rings 405. The key 408 can extend generally perpendicularly with respect to a plane of the rings 405. The key 408 can have a generally rectangular cross-section when taken in either of two generally orthogonal planes.

A gap 407 can be formed in each of the rings 405. The gap 407 of each one of the rings 405 can be configured to receive at least a portion of the key 408 of another one of the rings 405. The gap 407 can have a generally rectangular cross-section when taken in either of two generally orthogonal planes. Thus, a pair of the rings 405 can be configured to interlock with one another such that the two rings 405 can rotate, but can only rotate substantially in unison with respect to one another.

In an embodiment, the key 408 and the gap 407 of each ring 405 can be formed such that a pair of the rings 405 are nestable with the key 408 of each of the rings 405 being disposed at least partially within the gap 407 of each other of the rings 405 while the rings 405 are substantially flush with respect to one another. The nesting of the rings 405 interlocks the rings 405 such that the rings 405 rotate in unison.

In an embodiment, the gaps 407 of the two rings 405 can be diametrically opposed with respect to one another when the rings 405 are interlocked. Since the two rings 405 rotate substantially in unison, the gaps 407 do not align in a fashion that facilitates increased gas flow past the rings 405.

In an embodiment, the rings 405 can be formed of stainless steel. For example, the rings 405 can be formed of 17-4 stainless steel. Various other materials, including refractory materials such as ceramics, are contemplated.

In an embodiment, the groove 402 can be substantially rectangular in cross-section. In such an embodiment, the rings 405 can also be substantially rectangular in cross-section and thus can be generally complementary in size and shape with respect to the groove 402.

FIG. 5 is an enlarged side view of the piston 400 having one ring 405*a* fully installed thereon and having one ring 405*b* partially installed thereon, according to an embodiment. The rings 405 can be temporarily bent or spring deformed in order to slide over the piston 400 and into the groove 402. The key 408 of the second ring 405*b* is positioned to be received at least partially within the gap 407 of the first ring 405*a*.

FIG. 6 is an enlarged perspective view of the piston 400 having two rings 405 installed thereon, according to an embodiment. The two rings 405 are seated within the groove 402. The key 408 of the second ring 405*b* is disposed at least partially within the gap 407 of the first ring 405*a*.

According to various embodiments, a device can comprise a first ring 105*a*, 405*a* configured to be at least partially received within a groove 102, 402 of a piston 101, 400 of a gas operated firearm 700, 800. A second ring 105*b*, 405*b* can be configured to be at least partially received within the groove 102, 402. The first ring 105*a*, 405*a* and second ring 105*b*, 405*b* can be configured to interlock with one another such that the first ring 105*a*, 405*a* and second ring 105*b*, 405*b* rotate substantially in unison within the groove 102, 402. Various means for effecting such interlocking are contemplated. The use of a key 108, 408 and a gap 107, 407 as discussed herein are by way of example only, and not by way of limitation.

Any desired number of rings 105, 405 and any desired number of grooves 102, 402 in the piston 101, 400 may be used. For example, two grooves 102, 402, each having two rings 105, 405 or three rings 105, 405 apiece may be used. Thus, various embodiments may comprise 2, 3, 4, 5, 6, or more rings 105, 405.

In various embodiments, the gaps 107, 407 can be partial gaps that do not extend entirely though the rings 105, 405. For example, the gaps 107, 407 can be sufficiently sized to receive at least a portion of the keys 108, 408 while not forming a separation in the rings 105, 405. Thus, the gaps 107, 407 may be depressions, indentations, or cutouts, for example. Any desired number and configuration of the gaps 107, 407 and the keys 108, 408 can be used. The gaps 107, 407 and the keys 108, 408 can be generally complementary with respect to one another. The gaps 107, 407 and the keys 108, 408 can be non-complementary with respect to one another.

The piston rings 105, 405 need not be received within a groove 102, 402 of the piston 101, 400. Rather, the piston rings 105, 405 can be placed upon the piston 101, 400 and can be held in position by any means or structure desired. The piston rings 105, 405 can cooperate with the piston 101, 400 to mitigate gas leakage past the piston 101, 400.

Figure 7:
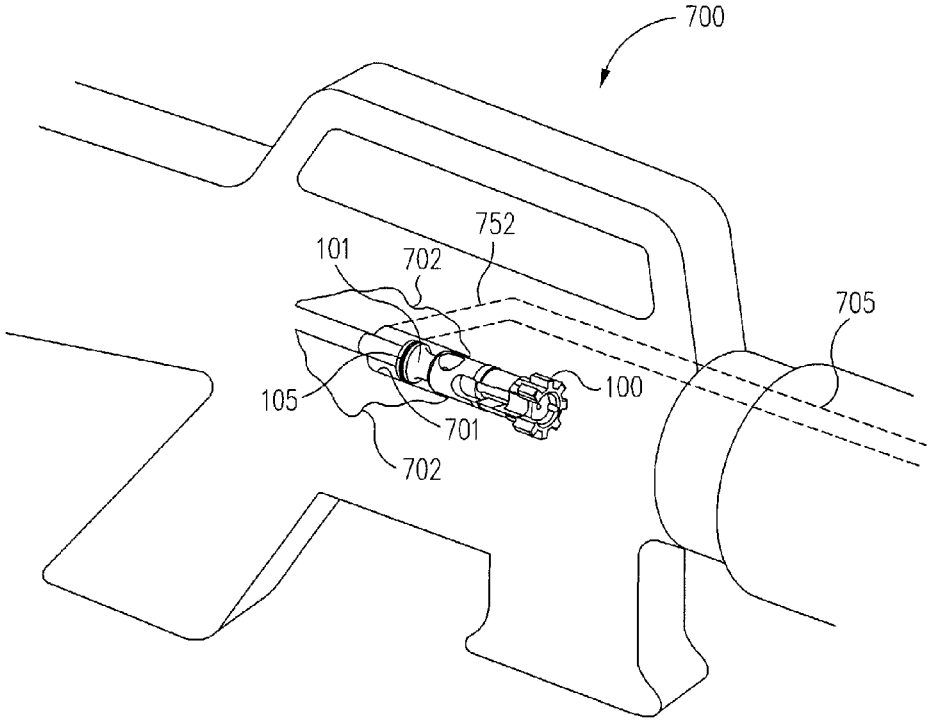
FIG. 7 is a perspective view of a firearm having the bolt of FIG. 1, according to an embodiment.

FIG. 7 is a perspective view of a firearm 700 having the piston 101 (see FIG. 1) formed on a bolt 100, according to an embodiment. The firearm 700 can be an M16 or an M4, for example. The firearm 700 can have one or more pairs of rings 105 disposed about the piston 101 thereof to mitigate gas leakage past the piston 101, as discussed herein.

Figure 8:
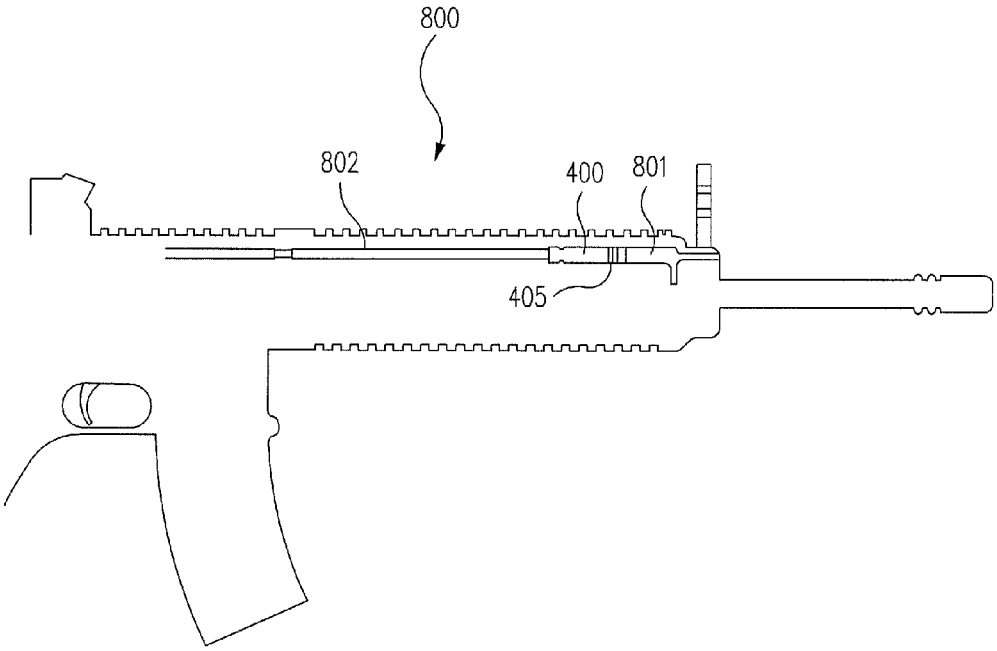
FIG. 8 is a perspective view of a firearm having the piston of FIG. 4, according to an embodiment.

FIG. 8 is a perspective view of a firearm 800 having the piston 400 (see FIG. 4), according to an embodiment. The firearm 800 can be an HK416, for example. The firearm 800 can have one or more pairs of rings 405 disposed about the piston 400 thereof to mitigate gas leakage past the piston 400, as discussed herein.

In operation, a shooter fires the firearm 700, 800 and hot, high pressure gas is provided by the cartridge. For an M16 or M4 type of rifle, the gas travels through a front sight 750 to the gas tube 705, then through the gas tube 705 and a bolt carrier key 752 to the bolt carrier 702, where the gas moves the bolt carrier 702, and consequently the bolt 100, so as to effect extraction of the spent cartridge and chambering of a new cartridge. The bolt 100 is disposed within a cylinder 701 formed in the bolt carrier 702. For an HK416 type of rifle, the gas moves the piston 400 within the gas cylinder 801 so as to move a tappet or operating rod 802 to effect extraction of a spent cartridge and chambering of a new cartridge.

In either instance, the use of rings 105, 405 having gaps 107, 407 and keys 108, 408 that facilitate nesting or interlocking of the rings 105, 405 substantially mitigates undesirable gas flow past the piston 101, 400. The nested or interlocked rings 105, 405 provide increased resistance to such gas flow by preventing the gaps 107, 407 from aligning with respect to one another. For example, gas can be substantially forced to follow a longer and more contorted path under the rings 105, 405 from which the gas reemerges to flow past the piston 101, 400. This longer and more contorted path around four corners substantially inhibits such gas flow and consequently inhibits gas leakage past the piston 101, 400.

Firearms 700 that have the piston 101 formed on the bolt 100 thereof can be referred to herein as M16/M4's, or M16/M4 types of firearms, or members of an M16/M4 family of firearms. Firearms 800 that do not have the piston 101 formed on the bolt 100 thereof can be referred to herein as HK416's, HK416 types of firearms, or members of an HK416 family of firearms.

Thus, according to one or more embodiments, two rings can be nested such that undesirable gas leakage past the piston is substantially inhibited. In this manner, damage to the rings can be substantially mitigated and fouling of components of the firearm, such as within the receiver thereof, can be substantially mitigated. By inhibiting gas leakage past the piston, reliability of the firearm is substantially enhanced and operation of the firearm is made more uniform.

Some gas operated firearms use a contemporary gas tube to deliver high pressure, very hot, gas to the piston 101 formed upon the bolt 100, as discussed herein. The M16 and the M4 are examples of firearms 700 that deliver gas to the piston 101 formed upon the bolt 100 via a contemporary gas tube. When the firearm 700 is shot repeatedly over an extended length of time, such as during extended fully automatic fire using a plurality of high capacity magazines, the contemporary gas tube can heat up. In such instances, the temperature of the contemporary gas tube can be excessive and thus undesirable damage to the contemporary gas tube can result. When the gas tube heats up, the length and/or diameter of the gas tube can increase substantially due to thermal expansion. Such thermal expansion can interrupt the firing cycle of the firearm and thus result in the firearm becoming inoperative. As such, it is desirable to provide methods and systems for mitigating heat build up and for accommodating thermal expansion of gas tubes in gas operated firearms.

A heat dissipating gas tube 705 can have enhanced heat dissipation such that during extended fully automatic fire the gas tube 705 can remain at a sufficiently low temperature as to not incur substantial damage. An example of such a gas tube 705 is discussed below with reference to FIGS. 9-12, according to one or more embodiments.

According to one or more embodiments, a gas tube 705 provides enhanced heat dissipation and/or enhanced heat accommodation, as discussed with reference to FIGS. 9-12. The enhanced heat dissipation tends to inhibit overheating of the gas tube 705. The enhanced heat accommodation tends to allow the gas tube 705 to continue to function properly when heated, particularly when heated by sustained fully automatic fire.

Figure 9:
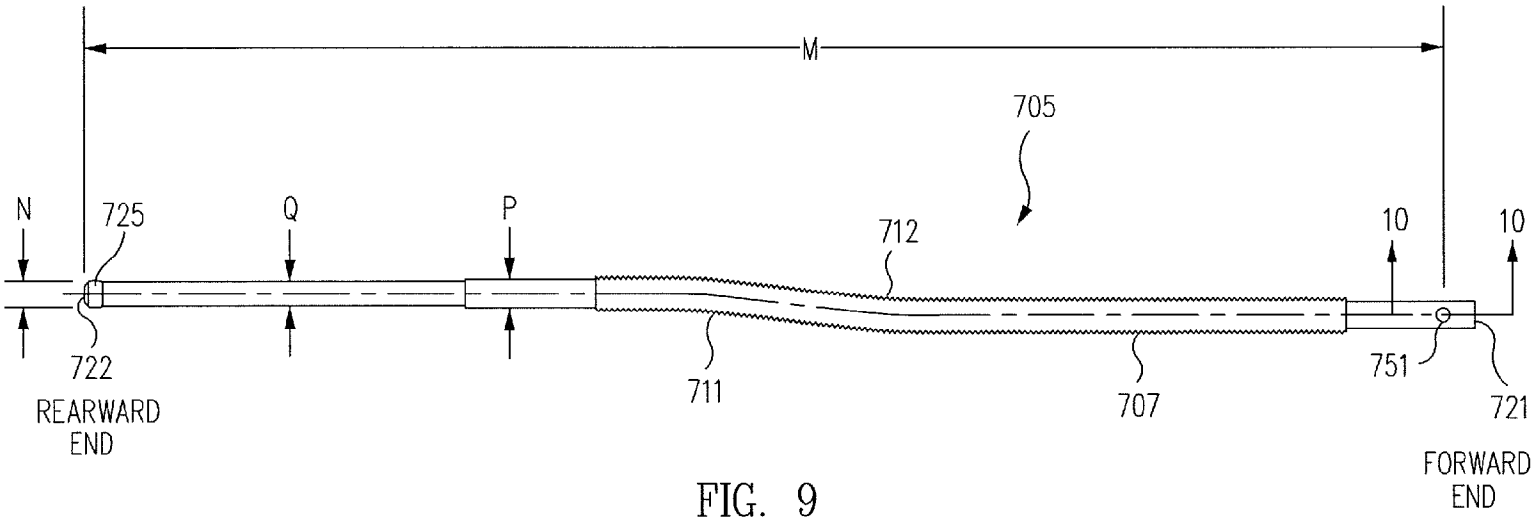
FIG. 9 is a heat dissipating gas tube for a firearm, according to an embodiment.

FIG. 9 is the gas tube 705 for an M16 and/or M4 type of firearm 700, according to an embodiment. The gas tube 705 can have a heat dissipater formed thereon. For example, the gas tube 705 can have threads 707 formed upon a substantial portion of the length of the gas tube 705.

Other examples of heat dissipaters can include fins, fingers, and any other structures that tend to increase the surface area of the gas tube 705 and thus enhance radiation of heat from the gas tube 705. A plurality of spaced apart annular fins can substantially encircle the gas tube 705, for example. A plurality of longitudinal fins can extend along a length of the gas tube 705, for example. A spiral fin can extend around a length of the gas tube 705, for example.

The outer diameter and/or the inner diameter of the gas tube 705 can be increased to enhance the ability of the gas tube 705 to operate under extended fully automatic fire. For example, in one embodiment, the outer diameter of the gas tube 705 or a portion of the gas tube 705 can be increased from the standard 0.180 inch to approximately 0.218 inch.

According to an embodiment, the threads 707 can be ¼-32 UNEF (Unified National Extra Fine) threads, for example. Various other types of the threads 707 are contemplated. More than one type of the threads 707 can be used. Any desired combination of the threads 707 or types of the threads 707 can be used. In one embodiment, the threads 707 can extend along a portion of the length of the gas tube 705. For example, the threads 707 can extend along a portion of the gas tube 705 that is away from ends, 721 and 722, of the gas tube 705. Thus, the ends 721 and 722 of the gas tube 705 can have no threads 707 formed thereon. In one embodiment, the threads 707 can extend along the entire gas tube 705.

The threads 707 need not be conventional threads. The threads 707 need not be any type of standard threads, e.g., threads made according to an accepted standard. The threads 707 can be formed with a die. The threads 707 can be formed by machining. The threads 707 can be formed by any desired method.

The threads 707 can be integral with the gas tube 705. The threads 707 can be formed separately from the gas tube 705 and/or can be attached to the tube 705. The threads 707 can be formed of either the same material as the gas tube 705 or can be formed of a different material with respect to the gas tube 705.

In one embodiment, the threads 707 can be solely for heat dissipation. In one embodiment, the threads 707 can have another use other than heat dissipation. For example, the threads 707 can be used to mount the gas tube 705 to the firearm 700. Thus, at least one end of the gas tube 705 can screw into a threaded opening on the firearm 700.

The gas tube 705 can be configured to attach to a contemporary firearm 700. For example, the gas tube 705 can have a first bend 711 and a second bend 712 formed therein to facilitate mounting of the gas tube 705 to a contemporary firearm 700. The first bend 711 and a second bend 712 can align the forward end and the rearward end of the gas tube 705 with their respective connections to the firearm 700. A bead 725 can be formed on the reward end of the tube 705 to facilitate a desired fit into the bolt carrier key 752 (FIGS. 10 and 11) of the firearm 700.

In one embodiment, the gas tube 705 can be formed of stainless steel. For example, the gas tube 705 can be formed of 347 stainless steel. In one embodiment, the gas tube 705 can be formed of a refractory material, such as a ceramic material.

The gas tube 705, and more particularly the threads 707, can have any desired finish. For example, various textures, coatings, and treatments that enhance heat dissipation are contemplated.

Figure 10:
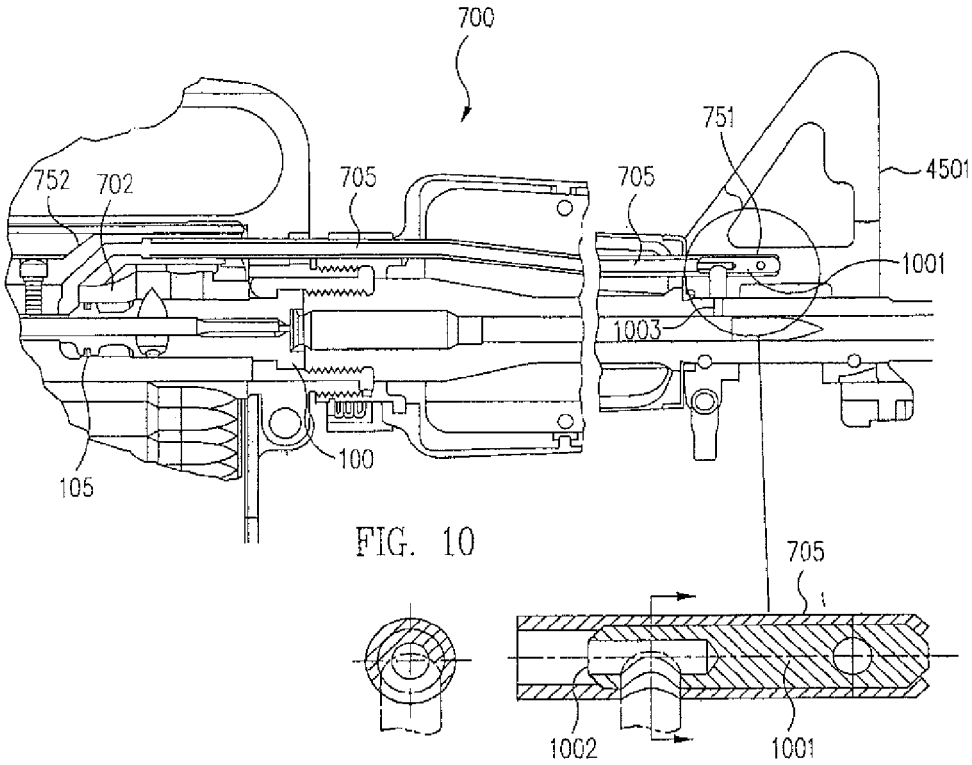
FIG. 10 is a cross-sectional view of a firearm having the heat dissipating gas tube and a gas metering plug, according to an embodiment.

FIG. 10 is a cross-sectional side view of a firearm 700 having the gas tube 705, according to an embodiment. The gas tube 705 and/or the rings 105 (see FIGS. 1-3) can be provided as a kit for upgrading contemporary firearms such as the M16 and M4. Thus, the gas tube 705 and the rings 105 can be provided and installed together. Such upgrading can be performed in the field, at an armory, or at a maintenance depot. The gas tube 705 and/or the rings 105 can be changed together. Either the gas tube 705 or the rings 105 can be changed alone (without changing the other). Thus, the gas tube 705 and the rings 105 can be changed or used independently with respect to one another.

In operation, a shooter fires the firearm 700, 800 and hot, high pressure gas is provided by the cartridge. For an M16 or M4 type of rifle, the gas travels through a front sight 750 to the gas tube 705, then through the gas tube 705 and the bolt carrier key 752 to the bolt carrier 702, where the gas moves the bolt carrier 702, and consequently the bolt 100, so as to effect extraction of the spent cartridge and chambering of a new cartridge. The bolt 100 is disposed within a cylinder 701 formed in the bolt carrier 702. During sustained fully automatic fire, the gas tube 705 is exposed to a substantial quantity of hot gases from the fired cartridges. According to an embodiment, the threads 707 provide increase surface area for radiating this heat so that the temperature of the gas tube 705 can be maintained within an acceptable range.

As the gas tube 705 heats ups, it expands both in length and diameter. According to an embodiment, the length, Dimension M, of the gas tube is sufficiently short so as to accommodate thermal expansion of the gas tube 705 in length without causing the firearm 700 to malfunction. According to an embodiment, the diameter, Dimension N, of the gas tube 705 is sufficiently small so as to accommodate thermal expansion of the gas tube 705 in diameter, particularly at the bolt carrier key 752 interface thereof, without causing the firearm 700 to malfunction.

Contemporary M16/M4 firearms have a gas tube 705 with a plug at the front end of the gas tube 705. However, the plug of contemporary M16/M4 firearms does not substantially restrict gas flow. Contemporary M16/M4 firearms rely upon the gas port 1003 formed in the barrel to perform a gas metering function. The gas port 1003 is subject to erosion and thus suffers from substantial disadvantages with regard to this metering function.

More particularly, the M16 and M4 use the gas port 1003 diameter as the means to control the amount of gas flow. However, the forward corner of the gas port 1003 intersection with barrel bore is eroded from its original sharp corner into an enlarging triangle by the scrubbing of each passing bullet and the bombardment of propellant grains. This erosion of the gas port 1003 causes the gas flow therethrough to increase over time. As the gas flow increases, the gun cycle speeds up, undesirably resulting in feed jams, extraction failures, and/or carrier bounce. Misfires begin and grow worse over time until the gun cripples itself from excessively worn and/or broken parts.

To mitigate the undesirable effects of gas port erosion, a gas metering plug 1001 can be installed in the front end of the gas tube 705. The gas metering plug 1001 can have a gas metering hole 1002 that the gas from the barrel must flow through before entering the gas tube 705. According to an embodiment, the gas metering hole 1002 is out of reach of bullet scrubbing and the impact of propellant grains. The gas metering plug 1001 can be made of a heat resistant material, so that it remains substantially unchanged by any amount of firing. According to an embodiment, the gas metering hole 1002 is always smaller than the hole of the gas port 1003 (such that the gas metering hole 1002 always performs a gas metering function).

Thus, although the gas port 1003 continues to erode so that the gas flow that reaches the metering hole 1002 continues to increase in pressure, the gas metering hole 1002 meters the gas and thus mitigates the undesirable effects of gas port erosion so as to the extend the useful life of the gun.

Figure 11:
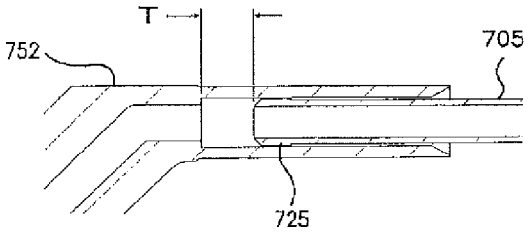
FIG. 11 is an enlarged cross-sectional side view of the rear end of the gas tube and a bolt carrier key that receives the rear end of the gas tube, according to an embodiment.

FIG. 11 is an enlarged cross-sectional side view of a forward end of the bolt carrier key 752 of FIG. 10. The rearward end or bead 725 of the gas tube 705 is received within the bolt carrier key 752. When a contemporary gas tube expands in length, such as due to the heat of sustained fully automatic fire, it may bottom out or interfere within the bolt carrier key 752, such that the gas tube bends undesirably due to such expansion. Such bottoming out and/or bending can inhibit uniform cycling or otherwise prevent desired operation of the firearm 700.

According to an embodiment, the gas tube 705 can be shorter in length, Dimension M of FIG. 9, such that additional or desirable clearance, Dimension T, is provided between the bead 725 and any portions of the bolt carrier key 752 that the bead 725 can bottom out or interfere with during such expansion. Thus, the likelihood of such bottoming out or interference is substantially mitigated.

According to an embodiment, the bead 725 can have a reduced diameter, Dimension N of FIG. 9, such that expansion of the diameter thereof is less likely to cause the bead 725 to interfere, bind and/or not move freely within the bolt carrier key 752. Thus, undesirable binding of the gas tube 705 within the bolt carrier key 752 can be substantially mitigated. Such binding can undesirably increase the likelihood of the gas tube 705 bending and/or the firearm 700 malfunctioning.

According to an embodiment, the gas tube 705 can be shorter in length, Dimension M and the bead 725 can have a reduced diameter, Dimension N. Thus, undesirable interferences can be mitigated and uniformity of cycling can be enhanced and a more reliable firearm can be provided.

Figure 12:
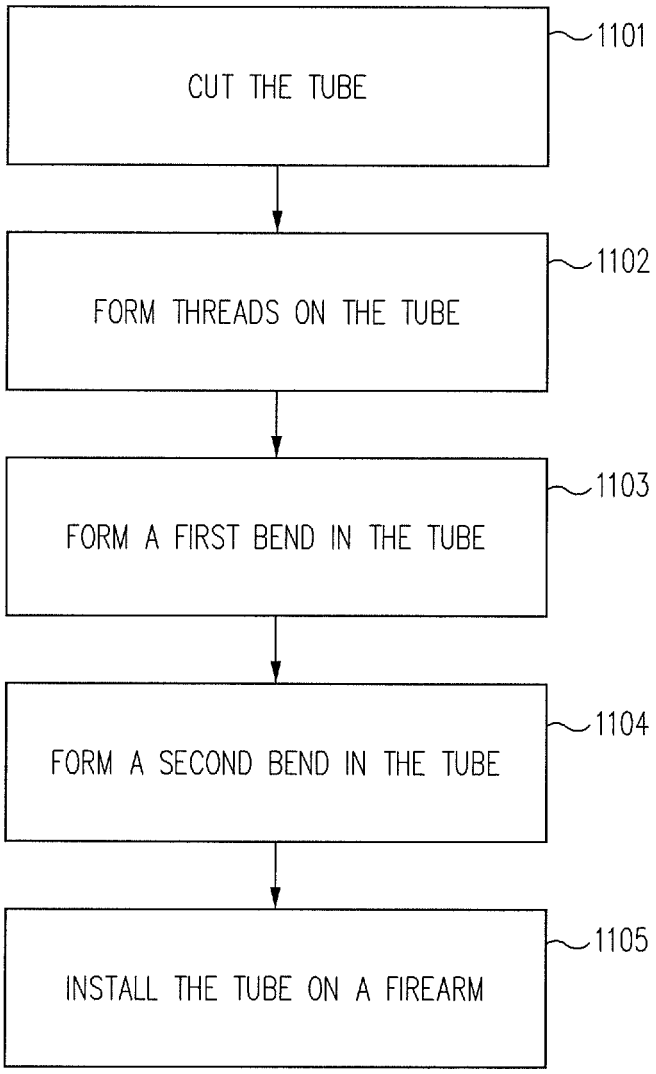
FIG. 12 is a flow chart showing a method for making a firearm having a heat dissipating gas tube, according to an embodiment.

FIG. 12 is a flow chart showing a method for making a firearm 700 having the gas tube 705, according to an embodiment. The method can comprise cutting a piece of ¼ OD×0.065 wall, stainless steel tubing, for example, to a desired length as shown in block 1101. For example, the tubing can be cut to a length of approximately 9.668 inches. The tubing can be cut with a tubing cutter or a saw, for example.

The method can further comprise forming threads 707 upon the cut tubing, as indicated in block 1102. For example, ¼-32 threads can be formed upon a section of tubing having a diameter of approximately 0.250 inch. The threads 707 can be formed with a lathe or with a die, for example.

The method can further comprise forming a first bend 711 in the tubing, as indicated in block 1103. A second bend 712 can be formed in the tubing, as indicated in block 1104 to define the gas tube 705. The first bend 711 and the second bend 712 can be formed consecutively or simultaneously. The first bend 711 and the second bend 712 can be formed using a fixture, jig, or tubing bend, for example.

The gas tube 705 can be installed in a firearm 700 as indicated in block 1105. For example, the gas tube 705 can be installed in an M16 or an M4 type of firearm 700. The bead 725 can be formed on the reward end of the tube 705 to facilitate a desired fit into a gas block interface of the firearm 700. The bead 725 can be formed at any desired point in the fabrication process. For example, the bead 725 can be formed either before or after the threads 707 are formed.

Referring again to FIG. 9, the gas tube 705 can comprise a gas tube retention hole 751 that is used to pin (attach) the tube to the front sight 750. According to an embodiment, the length, Dimension M, of the gas tube 705 from the center of the gas tube retention hole 751 to the rear end of the gas tube 705 and/or the rear end diameter, dimension N, of the bead 725 can be approximately the same as for a contemporary gas tube for an M16 and/or M4. For example, Dimension M can be approximately 9.600 inches for an M4 and can be approximately 14.98 inches for an M16. For example, Dimension N can be approximately 0.180 inch. Thus, in one or more embodiments the gas tube 705 can readily replace the contemporary gas tube of an M16 and/or M4.

According to an embodiment, the length, Dimension M, and/or the rear end diameter, Dimension N, of the bead 725 can be less than for a contemporary gas tube for an M16 and/or M4. For example, Dimension M can be less than 9.570 inches for an M4 and can be less than 14.95 inches for an M16. For example, Dimension N can be less than 0.1792 inch diameter. Thus, the gas tube 705 can be approximately 0.100 inch shorter and can have an outer diameter of approximately 0.001 inch less at the rear end, i.e., the bead 725, as compared to a standard gas tube for the same firearm. One or more embodiments can fit within the bolt carrier key 752 of an M16 and/or M4 and can readily replace contemporary gas tubes. The shorter length, Dimension M, and the smaller outer diameter, Dimension N, can better accommodate thermal expansion, such as can be caused by using larger capacity magazines. Thus, the gas tube 705 can have further enhanced heat resistance.

According to an embodiment, the outer diameter, Dimension Q, of a portion of the gas tube 705 at the rear end thereof can be approximately 0.171 inch. The diameter, Dimension P, of the gas tube 705 can be 0.186 inch.

The dimensions of the gas tube 705, as well as the configuration thereof, including any bends therein, can be whatever is necessary to fit a particular firearm. More or less than two bends can be used. Thus, the gas tube 705 can have any desired shape and configuration.

One or more embodiments can provide a replacement for contemporary gas tubes. Such embodiments are less prone to overheating and less likely to malfunction due to heat induced weakness and/or heat induced thermal expansion, particularly during sustained fully automatic fire of the firearm 700. Thus, the firearm 700 can cycle and fire more uniformly and can be substantially more reliable.

One or more embodiments can provide a replacement for contemporary gas tubes that can withstand the heat of firing at least as well as other components of the firearm. Thus, a failure or problem with the gas tube will be substantially less likely to be the cause of a malfunction of the firearm.

One or more embodiments can be used in various different gas operated rifles, carbines, pistols, and the like. Although embodiments are discussed herein with respect to the M16/M4 and HK416, such discussion is by way of illustration only and not by way of limitation. Various embodiments can be used with various gas operated firearms, including rifles, carbines, and pistols.

As those skilled in the art will appreciate, the M16 service rifle and the M4 carbine have a variety of reliability shortcomings. According to various embodiments, methods and systems are provided for inhibiting undesirable forward and rearward bouncing of a bolt carrier of a gas operated firearm, such as an M16 and/or an M4. These methods and systems can be used in combination with other methods and systems described herein to mitigate at least some of these shortcomings. For example, a drop in replacement kit can be provided to address at least some of these shortcomings.

An often neglected problem in gas operated firearms is gas port erosion. Gas port erosion causes the gas port to become larger, which allows more gas to be used and thus gradually speeds up the gun cycle. Speeding up the gun cycle can cause feed jams, failures to extract, and carrier bounce misfires. It can also increase wear on the firearm and reduce accuracy during use of the firearm.

The M4 carbine has more trouble with gas port erosion than the M16 rifle, even though both of these firearms use the same bolt carrier group. The M4's gas port location is closer to the chamber, where gas port erosion is more aggressive. Because of gas port erosion, the M4's unlocking cam can begin to unlock too early in the fires cycle and thus can cause the firearm's bolt to break at the lugs or cam pin hole. This typically doe not occur in the M16 rifle and typically does not occur in new M4s. It generally only occurs in M4s that have fired enough to substantially erode the gas port. In addition to reliability problems, the resulting high rate of fire makes the gun less controllable on full auto, wastes ammunition, and intensifies heat problems.

Anticipating that 60-shot and perhaps even 100-shot magazines may soon replace the current standard 30-shot M16/M4 magazines, the consequent heat problems associated with such increased capacity (and the resulting extended rapid firing of the firearm) also need to be addressed. The M4 gas tubes can soften and bend (and thus become inoperable) in as few as four 100-shot bursts. The M16 gas piston rings can burn out in as few as two 100-shot bursts. To mitigate such heat problems, the piston rings and thick wall threaded gas tube may be used, as discussed herein.

Figure 13:
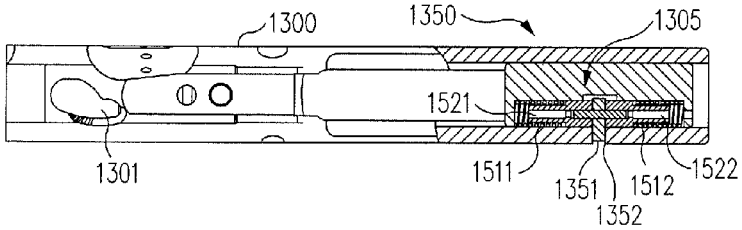
FIG. 13 is a top view of a bolt carrier having an anti-bounce assembly, according to an embodiment.
Figure 14:
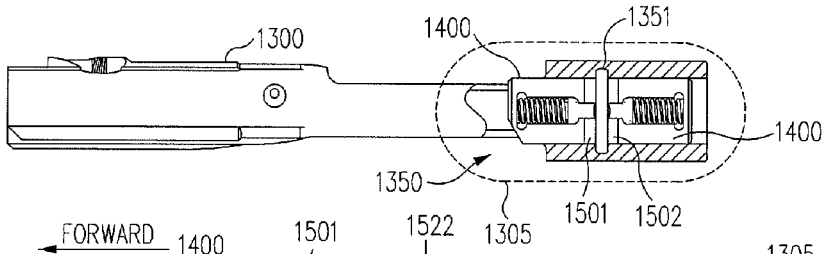
FIG. 14 is a side view of the bolt carrier of FIG. 13, according to an embodiment.

FIG. 13 is a top view of a bolt carrier having a longer dwell and an anti-bounce assembly, according to an embodiment. To prevent broken bolts, a double cut cam can have a 0.062 longer dwell 1301 (also shown in FIGS. 18, 23, 28, 32, 33) than the standard cam, before the unlocking cam surface 3301 (see FIG. 33) begins to rotate the bolt to its unlocked position. This longer dwell at least partially compensates for the time differences between the M16 unlocking start and the early start of the M4 due to its rearward gas port location. The force on the locking lugs causing them to bind is thus reduced to the same resistance as in the M16 rifle, so that the cause of broken bolts is substantially eliminated.

A single cut cam of the same new length with 0.062 longer dwell would have the same timing advantage, but the double cut has two additional advantages. The helix portion of the cam has wider clearance for dust and dirt. Although the unlocking earn surface 3301 has 0.062 longer time dwell, the cam pin and bolt head location on the locking side have the same starting location as the original cam so that the bolt head overtravels beyond the bolt holdopen device by the same amount giving the holdopen enough time to rise into position.

To mitigate the effect of gas port erosion and higher rate of fire (excessive cycle speed) three compatible but separate features can be used. First, the M16 and M4 use the gas port hole diameter as the means to control the amount of gas flow, but the forward corner of that gas port intersection with barrel bore can become eroded from its original sharp corner into an enlarging triangle caused by the scrubbing of each passing bullet and the bombardment of propellant grains. As gas flow increases, the gun cycle speeds up, feed jams, extraction failure, misfires begin and grow steadily worse until the gun cripples itself with worn or broken parts. To reduce this undesirable effect, a plug can be installed in the end of the gas tube and the plug can have a metering hole that the gas must flow through. Thus, the metering of gas flow is out of reach of bullet scrubbing and impact of propellant grains and is made of heat resistant material, so that the meter hole is unchanged by any amount of firing. Although the gas port hole continues to erode so that the gas flow that reaches the metering hole continues to increase in pressure, the metering hole (which can be configured such that it is always smaller than the gas port hole), reduces the effect of gas port erosion (not entirely, but significantly), to extend the useful life of the gun.

Second, it is not surprising that gas port erosion speeds up the firearm cycle, because the bolt group is thrown more vigorously to the rear. However, it is important to also appreciate that the forward cycle of the bolt group also undesirably speeds up. Faster forward movement is caused by bolt carrier bounce as the buffer and carrier impact the rear wall. The buffer doesn't bounce, but carrier does. If rear carrier bounce can be eliminated, then approximately half the rate of fire gain can be eliminated.

For example, assume that the cyclic rate of fire of a new M4 is 800 shots per minute and that the firearm has fired enough rounds to erode the gas port sufficiently to speed up the cyclic rate to 1000 shots per minute. This represents an increase of 200 shots per minute in the cyclic rate. If that increase were cut in half, the gain would only be 100 shots per minute. Thus, the firearm would have a cyclic rate of 900 shots per minute instead of 1000 shots per minute and the useful life of the firearm would be substantially extended.

When the bolt group begins to move forward slowly, it starts to push the top cartridge in the magazine forward, so that this cartridge enters the feed ramp at a slow speed and is smoothly cammed upward into the chamber opening. By way of contrast, if the bolt group bounces forward at high speed, then the bullet point hits the feed ramp (which is 7° steeper in the M4 than in the M16) at high speed. The bullet tends to bounce higher as the cyclic rate increase. When the cyclic rate increases sufficiently, the bullet will miss the chamber opening and jams the gun. Although this commonly occurs with contemporary 30-shot magazines, high capacity magazine provided by SureFire, LLC of Fountain Valley, Calif. are designed to feed reliably at a very wide range of cyclic rates.

Figure 26:
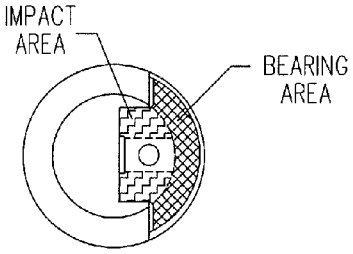
FIG. 26 is an end view of the modified bolt carrier of FIG. 23 showing an impact area and a bearing area, according to an embodiment.

Referring to FIGS. 13-18, 23, and 28, a combination rate reducer and anti-bounce assembly, referred to herein as anti-bounce assembly 1305, can be mounted in the rear tubular section 1350 common to a M16 and M4 bolt carrier 1300, according to an embodiment. The only modification needed to be made to the bolt carrier 1300 is a vertical cut or slot 1352 faulted through the left side wall of the bolt carrier 1300 as shown in FIG. 26.

The anti-bounce assembly 1305 can comprise of a steel cylinder or weight 1400 having two cavities 1501 and 1502 formed therein. Within each cavity 1501, 1502, a first spring 1511 and a second spring 1512 can be disposed. The first spring 1511 can be disposed in cavity 1501 upon a first plunger 1521 and the second spring 1512 can be disposed in cavity 1502 upon a second plunger 1522. The first plunger 1521 and the second plunger 1522 can be substantially hollow. The weight 1400 can be free to slide within the bolt carrier 1300 and can be biased centrally by the first spring 1511 and the second spring 1512, as discussed herein.

Figure 18:
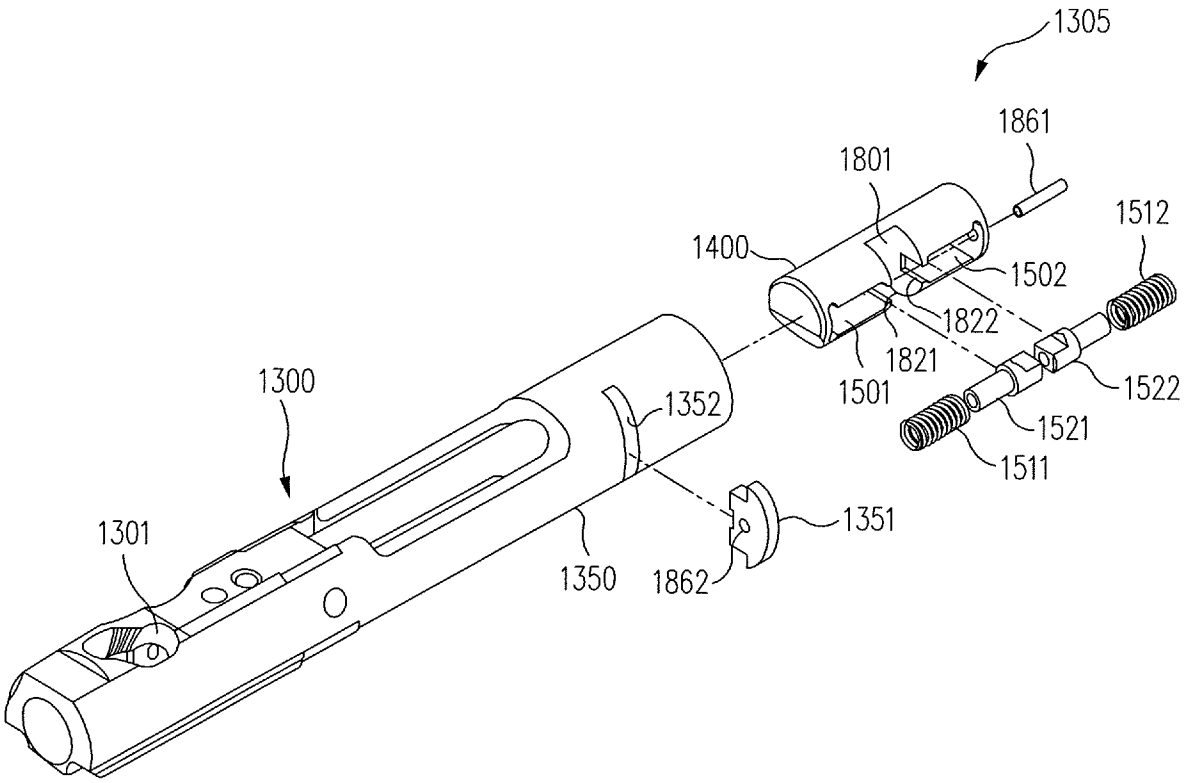
FIG. 18 is an exploded view of the bolt carrier of FIG. 13, according to an embodiment.

As shown in FIG. 18, a central cavity 1801 can be formed between the two cavities 1501 and 1502. The central cavity 1801 can define a continuous passage between the two cavities 1501 and 1502.

The two plungers 1521 and 1522 can extend through corresponding openings 1821 and 1822 (see FIG. 18) into the central cavity 1801. By inserting the anti-bound assembly 1305 into the tubular section 1350 of the bolt carrier 1300, then placing a flat anvil 1351 through a slot 1352 in the bolt carrier 1300 and on into the central cavity 1801, and then inserting a retaining pin 1861 through the hollow plungers 1521, 1522 and a hole 1862 in the anvil 1351, the anti-bounce assembly 1305 can be secured within the bolt carrier 1300.

Figure 15:
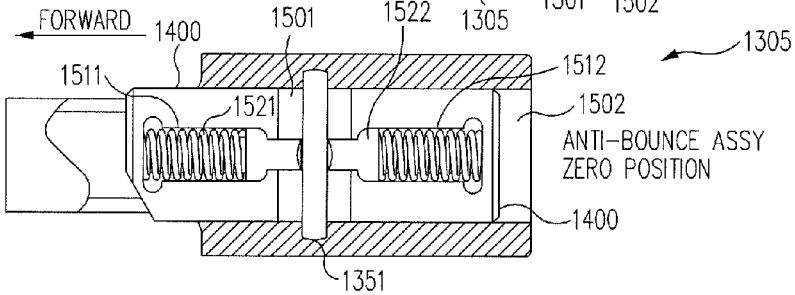
FIG. 15 is an enlarged side view of the anti-bounce assembly of FIG. 13 showing a double anti-bounce weight in a zero or non-impact position, according to an embodiment.
Figure 16:
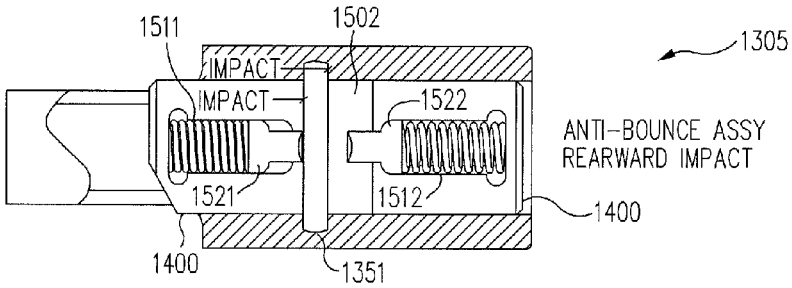
FIG. 16 is an enlarged side view of the anti-bounce assembly of FIG. 13 showing the double anti-bounce weight in a rearward impact position, according to an embodiment.
Figure 17:
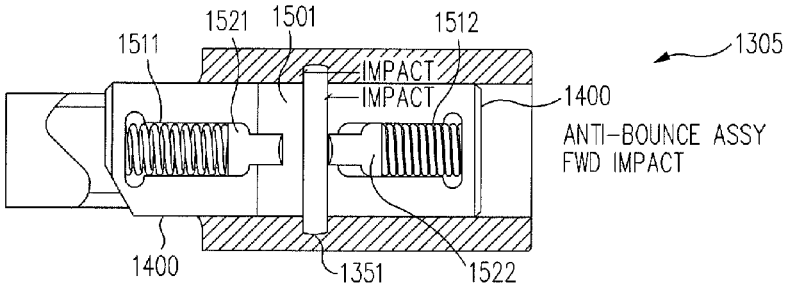
FIG. 17 is an enlarged side view of the anti-bounce assembly of FIG. 13 showing the double anti-bounce weight in a forward impact position, according to an embodiment.

The weight 1400 can have the two cavities 1501 and 1502, as well as the central cavity 1801 formed therein. The weight 1400 can slide fore and aft within the tubular portion 1350 of the bolt carrier 1300. The springs 1511 and 1512 can tend to center the weight 1400. The dimensions of the central cavity 1801 can allow the weight 1400 to move fore and aft approximately 0.10 inches, for example, before the weight 1400 impacts the anvil 1351. Such motion is resisted in either direction by the force of each spring 1511, 1512 and by the fact that each plunger 1521, 1522 has a travel limiting stop 1900 (see FIG. 19) formed thereon. Thus, when inertia drives the weight 1400 forward to strike the anvil 1351, then only the rearward spring 1512 is compressed (as shown in FIG. 17), while the forward spring 1511 and plunger 1521 move away from the anvil 1351 and the opposite occurs when the weight 1400 move rearward (as shown in FIG. 16). In that way, the springs 1511 and 1512 are preloaded and biased to hold the weight 1400 in mid position, e.g., approximately centered (as shown in FIG. 15) within its limits of travel.

When the bolt carrier 1300 impacts going forward and tries to bounce rearward the weight 1400 impacts forward again (as shown in FIG. 17) and vice-versa (as shown in FIG. 16). Thus, the weight 1400 partially defines an anti-bounce device in both directions, not just in the forward direction. Since the anti-bounce assembly 1305 mitigates rearward bounce, it is also a rate reducer (it tends to reduce the cyclic rate of a firearm). According to one or more embodiments, the anti-bounce assembly 1305 can be a semi-permanent installation, meaning that it can be removed (by driving the retaining pin into the forward plunger) or it can remain in place since the firing pin, cam pin, and bolt standard disassembly can be done with the device installed.

Figure 34:
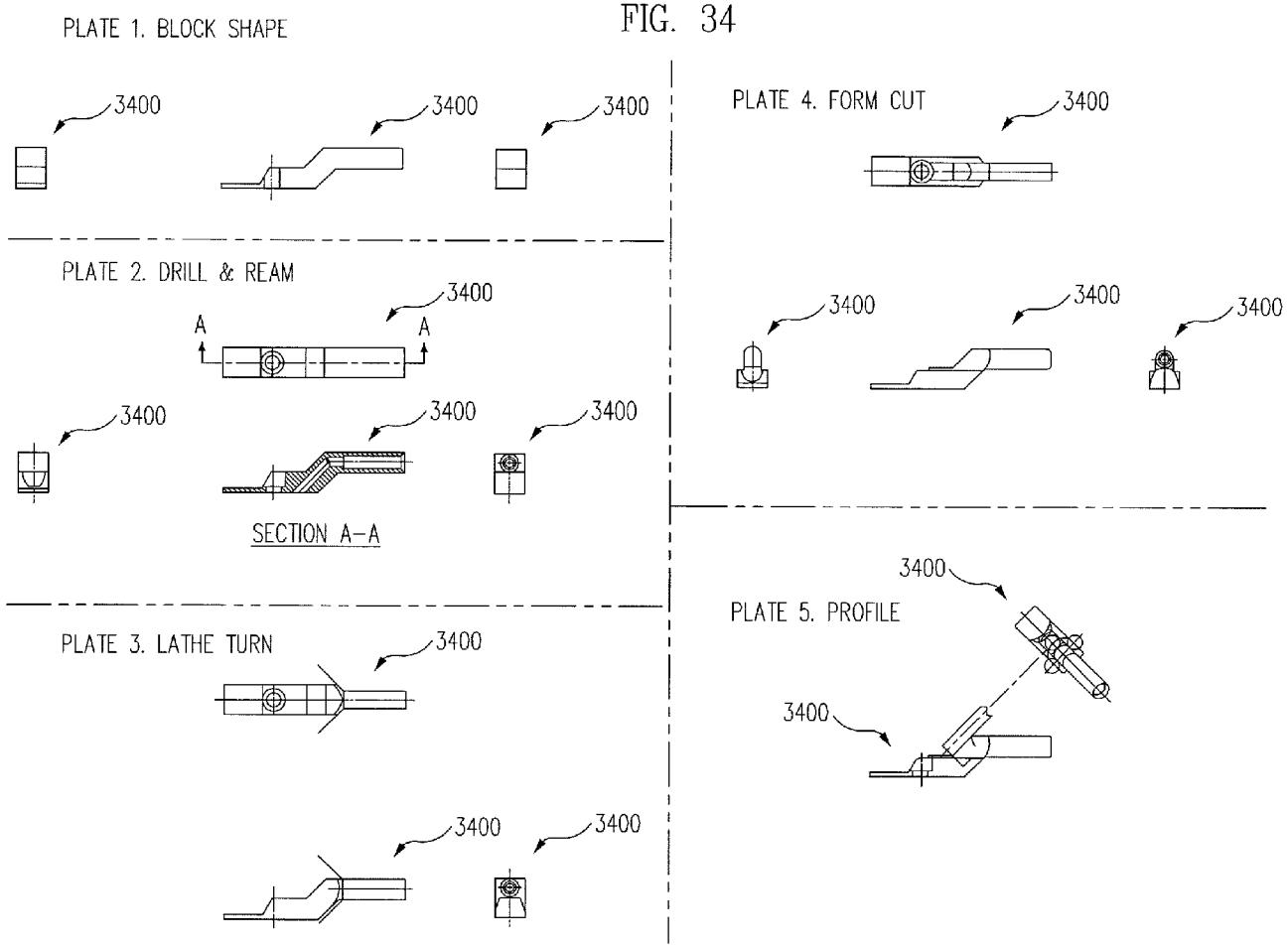
FIG. 34 includes various views showing a carrier key, according to an embodiment.

FIG. 34 includes various views showing a carrier key 3400, according to an embodiment. The use of a 0.500 inch shorter carrier key 3400, buffer, and main spring stack height increases the bolt carrier 1300 allowable travel about 13% and reduces the rate of fire to about 80% of what it otherwise is. Except for the design of the key 3400, the only change to the carrier 1300 can be that two number 8 screw holes are replaced with a single 10-32 screw hole.

Although this alone does not necessarily reduce parts wear, it can increase full auto controllability and hit probability, conserve ammunition and reduce heat buildup. Thus, operation and reliability can be enhanced.

The use of such a carrier key 3400 can comply and work normally without the shortened buffer. It can therefore be offered to create the option to use a shortened buffer and spring stack for a reduced rate of fire.

Figure 19:
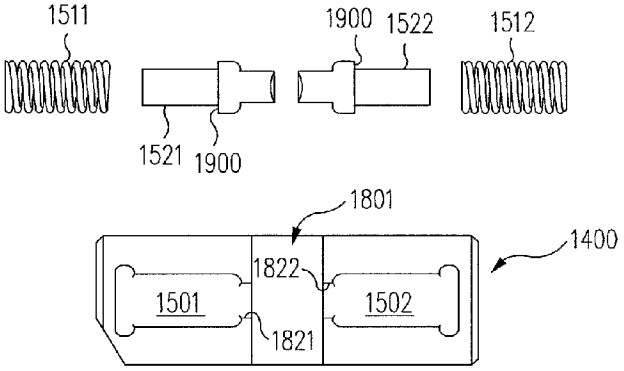
FIG. 19 is a top exploded view of the plungers, springs, and double anti-bounce weight of FIG. 18, according to an embodiment.

FIG. 19 is a top exploded view of the plungers, springs, and double anti-bounce weight of FIG. 18, according to an embodiment.

Figure 20:
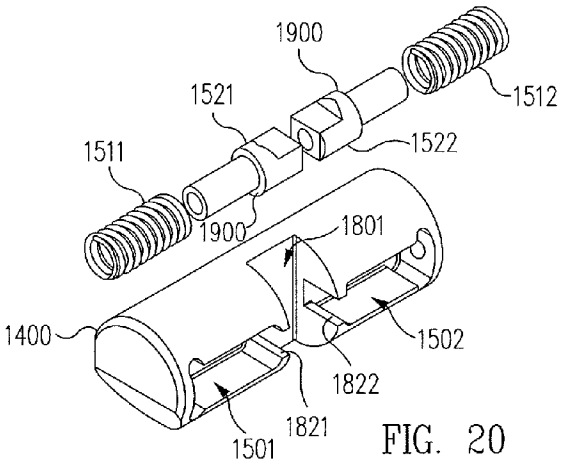
FIG. 20 is a perspective exploded view of the plungers, springs, and double anti-bounce weight of FIG. 18, according to an embodiment.

FIG. 20 is a perspective exploded view of the plungers, springs, and double anti-bounce weight of FIG. 18, according to an embodiment.

Figure 21:
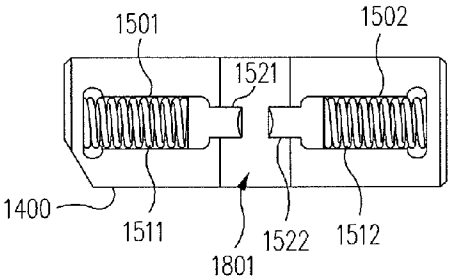
FIG. 21 is a top assemble view of the plungers, springs, and double anti-bounce weight of FIG. 18, according to an embodiment.

FIG. 21 is a top assemble view of the plungers, springs, and double anti-bounce weight of FIG. 18, according to an embodiment.

Figure 22:
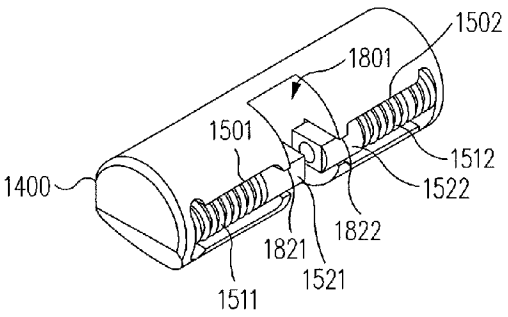
FIG. 22 is a perspective assembled view of the plungers, springs, and double anti-bounce weight of FIG. 18, according to an embodiment.

FIG. 22 is a perspective assembled view of the plungers, springs, and double anti-bounce weight of FIG. 18, according to an embodiment.

Figure 23:
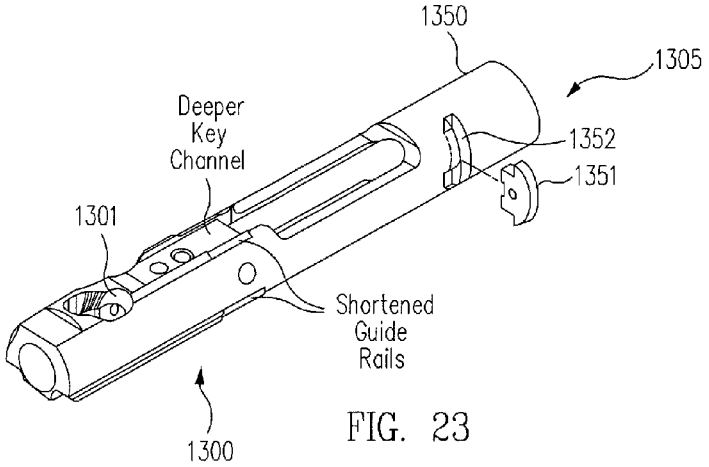
FIG. 23 is a perspective view of a modified bolt carrier, according to an embodiment.
Figure 24:
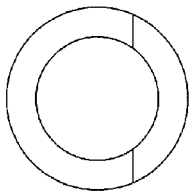
FIG. 24 is an end view of the modified bolt carrier of FIG. 23, according to an embodiment.

FIG. 24 is an end view of the modified bolt carrier of FIG. 23, according to an embodiment.

Figure 25:
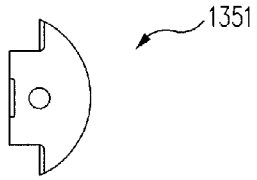
FIG. 25 is a side view of an anvil of FIG. 23, according to an embodiment.

FIG. 25 is a side view of an anvil of FIG. 23, according to an embodiment.

FIG. 26 is an end view of the modified bolt carrier of FIG. 23 showing an impact area and a bearing area, according to an embodiment.

Figure 27:
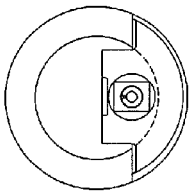
FIG. 27 is an end view of the modified bolt carrier of FIG. 23 showing a plunger, according to an embodiment.

FIG. 27 is an end view of the modified bolt carrier of FIG. 23 showing a plunger, according to an embodiment.

Figure 29:
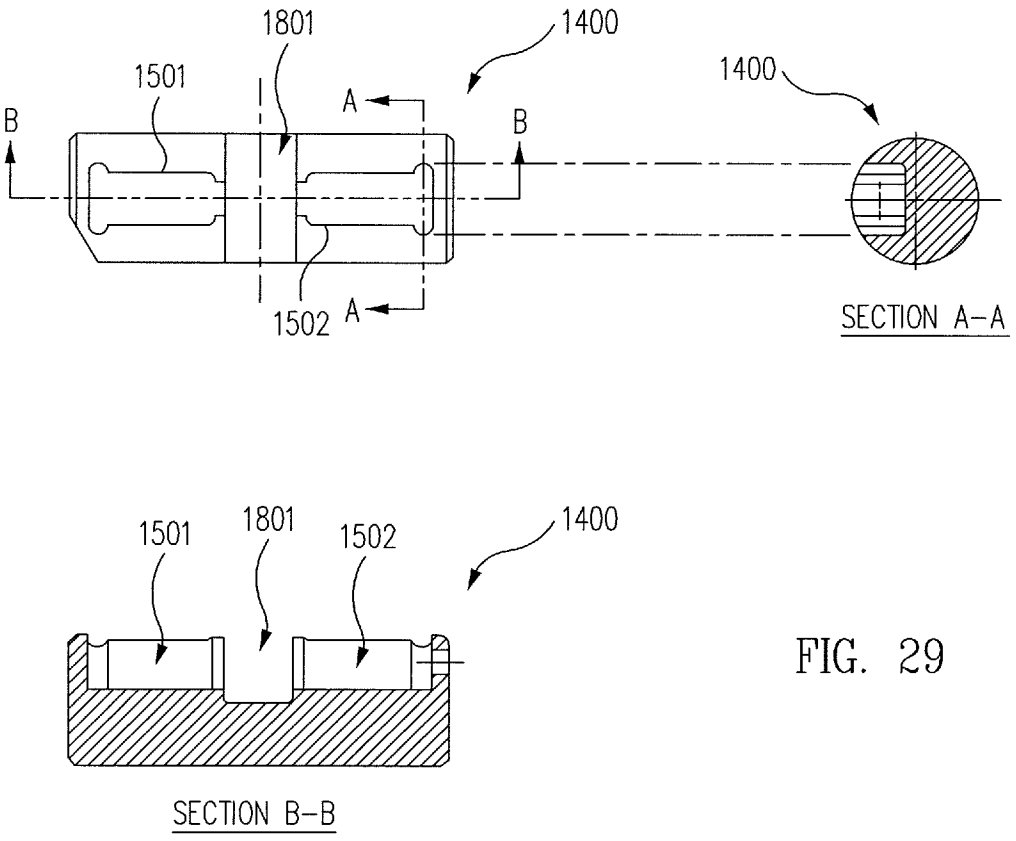
FIG. 29 includes various views of a double anti-bounce weight, according to an embodiment.

FIG. 29 includes various views of a double anti-bounce, according to an embodiment.

Figure 30:
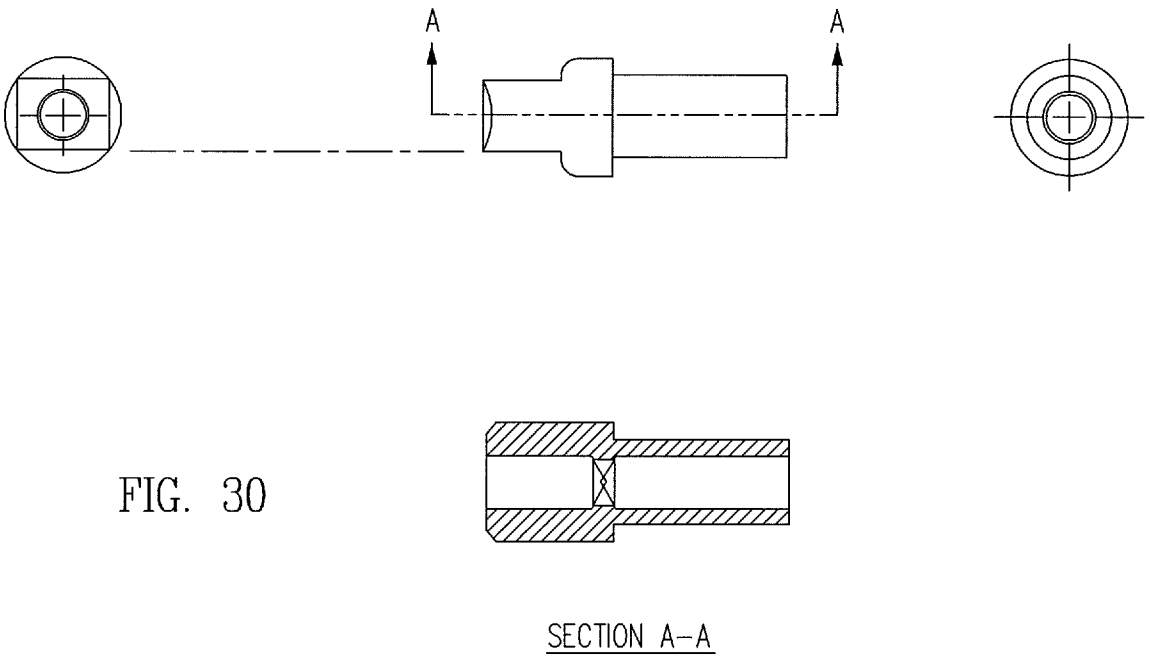
FIG. 30 includes various views of a plunger, according to an embodiment.

FIG. 30 includes various views of a plunger, according to an embodiment.

Figure 31:
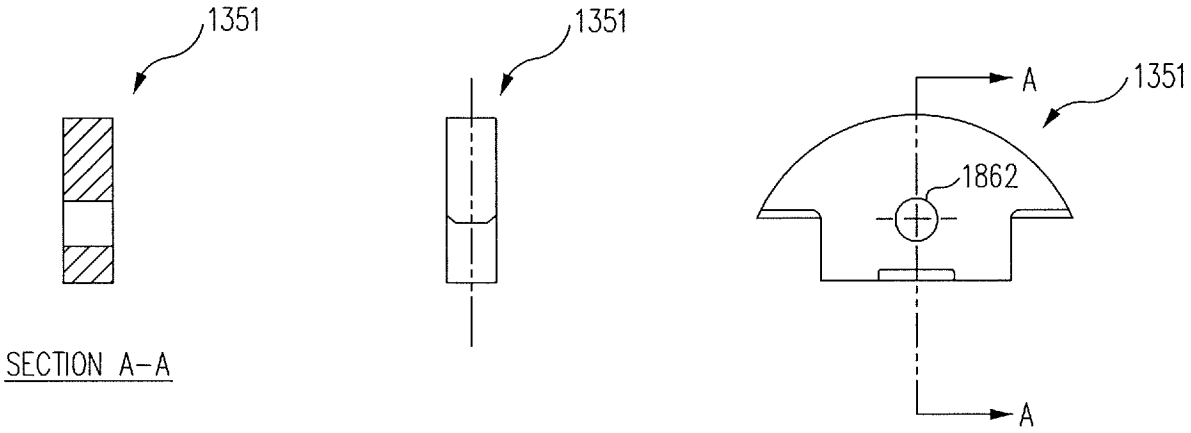
FIG. 31 includes various views of an anvil, according to an embodiment.

FIG. 31 includes various views of an anvil, according to an embodiment.

Figure 32:
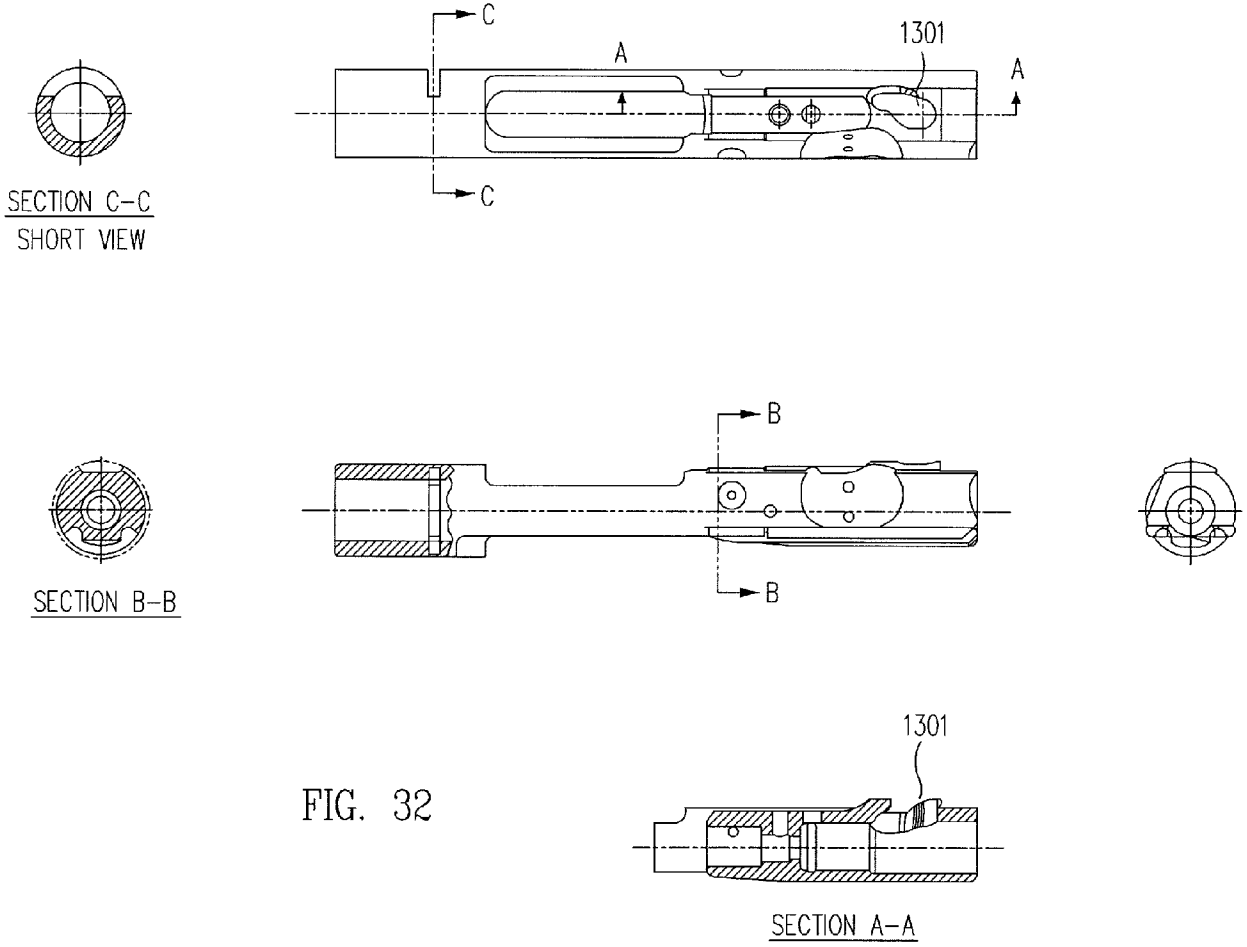
FIG. 32 includes various views showing a bolt carrier modification, according to an embodiment.

FIG. 32 includes various views showing a bolt carrier modification, according to an embodiment.

Figure 33:
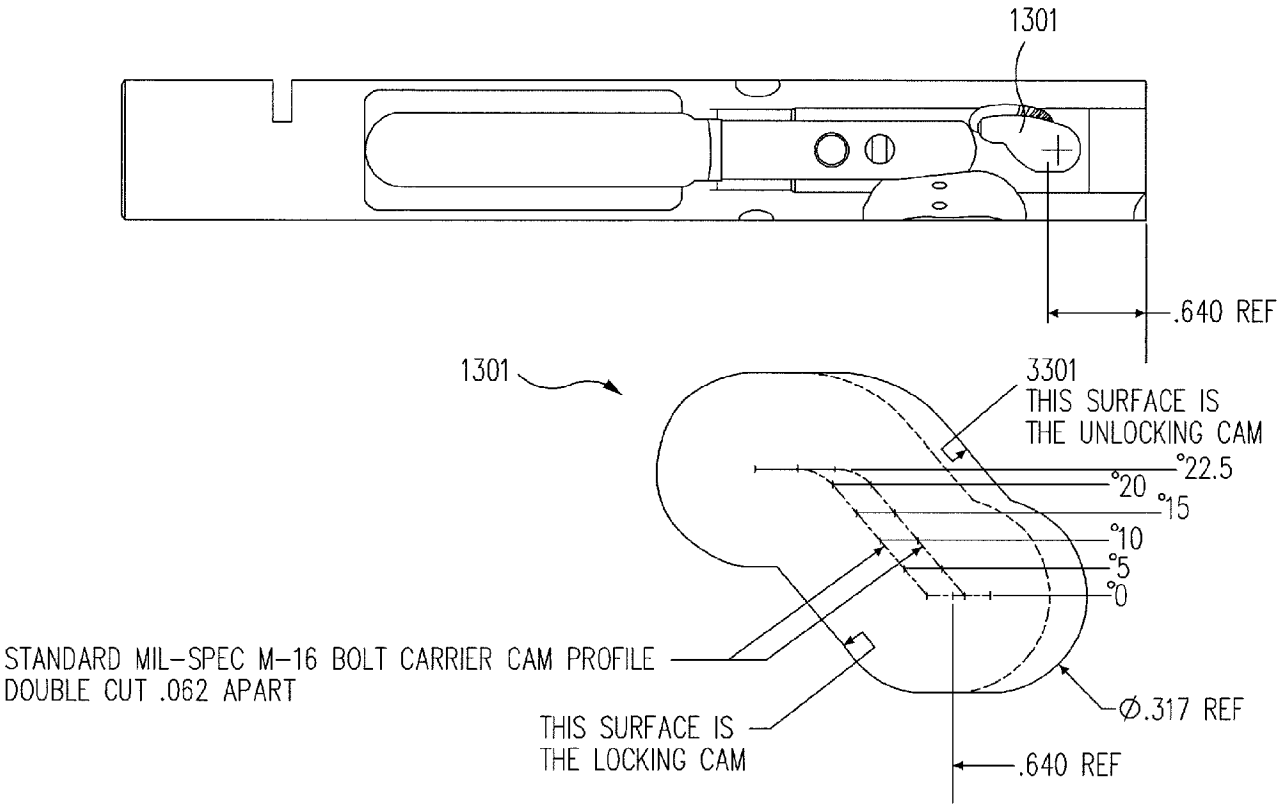
FIG. 33 includes various views showing a bolt carrier modification, according to an embodiment.

FIG. 33 includes various views showing a bolt carrier modification, according to an embodiment.

FIG. 34 includes various views showing a carrier key as discussed herein, according to an embodiment.

Figure 35:
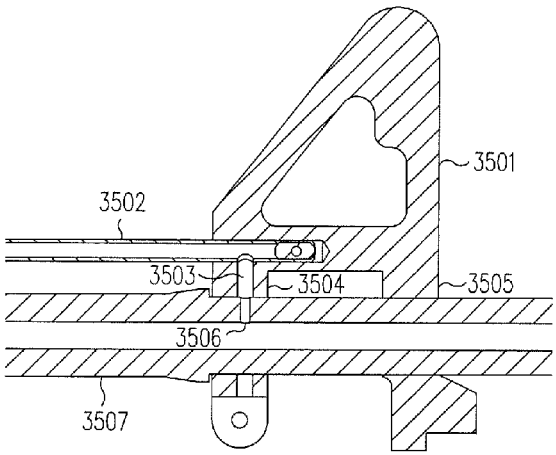
FIG. 35 (PRIOR ART)
FIG. 35 shows the front sight block and gas tube of a contemporary firearm, i.e., an M4 carbine.
Figure 36:
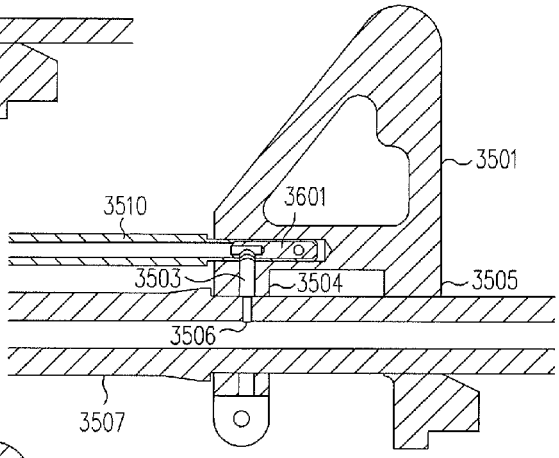
FIG. 36 shows a metering plug installed in a front sight block having the gas port in the standard location and showing the use of a thick wall gas tube, according to an embodiment.
Figure 37:
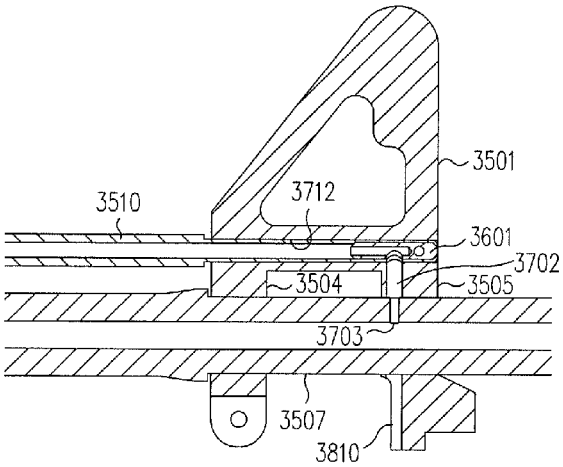
FIG. 37 shows a metering plug installed in a front sight block having the gas port moved to a forward location and showing the use of a thick wall gas tube, according to an embodiment.
Figure 38:
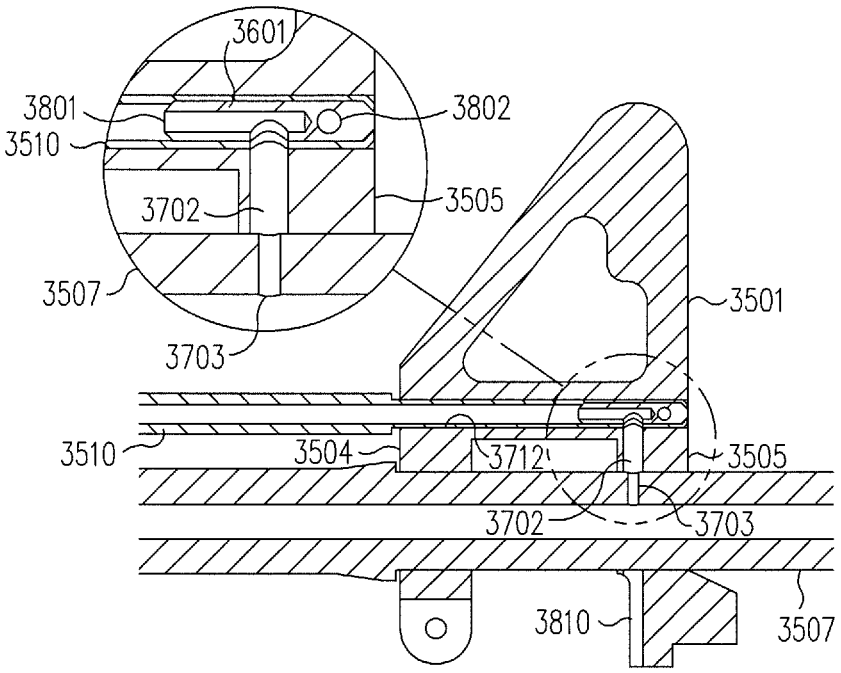
FIG. 38 shows a metering plug installed in a front sight block having the gas port moved to a forward location (with an enlarged view of the installed metering plug) and showing the use of a thick wall gas tube, according to an embodiment.
Figure 39:
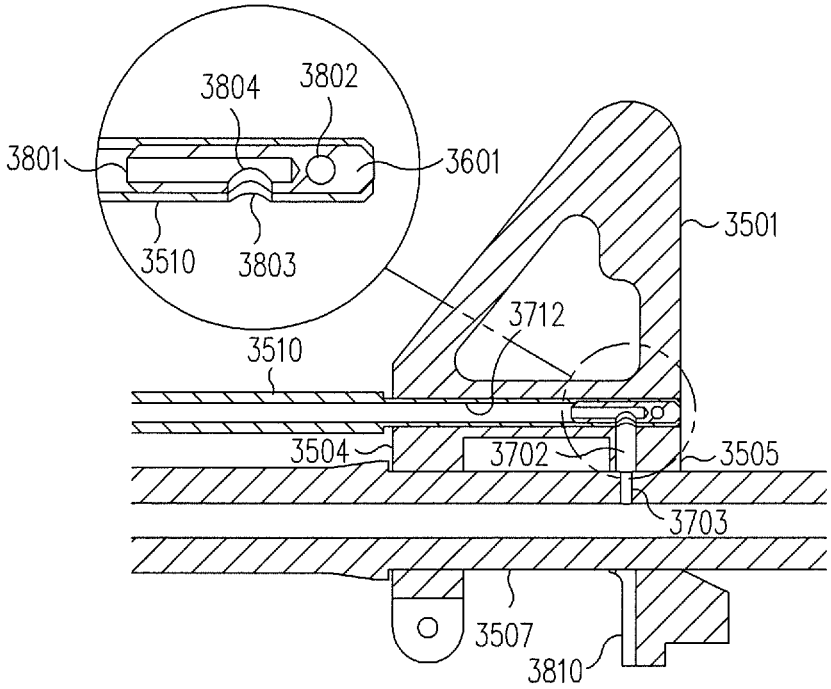
FIG. 39 shows a metering plug installed in a front sight block having the gas port moved to a forward location (with an enlarged view of the uninstalled metering plug and gas tube) and showing the use of a thick wall gas tube, according to an embodiment.
Figure 40:
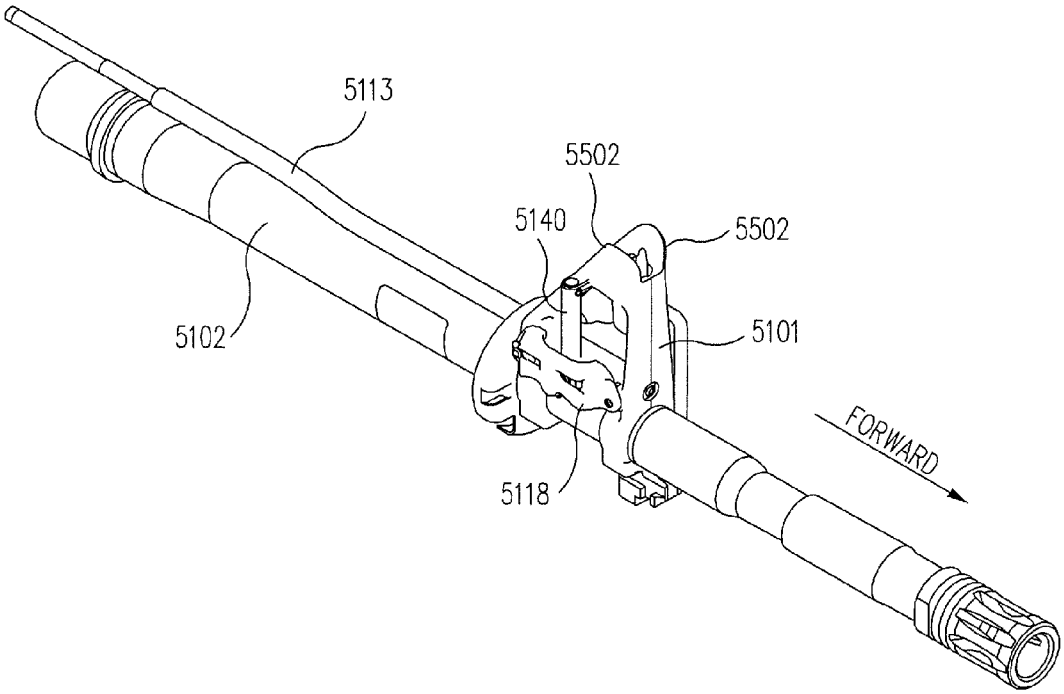
FIG. 40 shows a firearm barrel having a gas regulator installed thereon, according to an embodiment.
Figure 41:
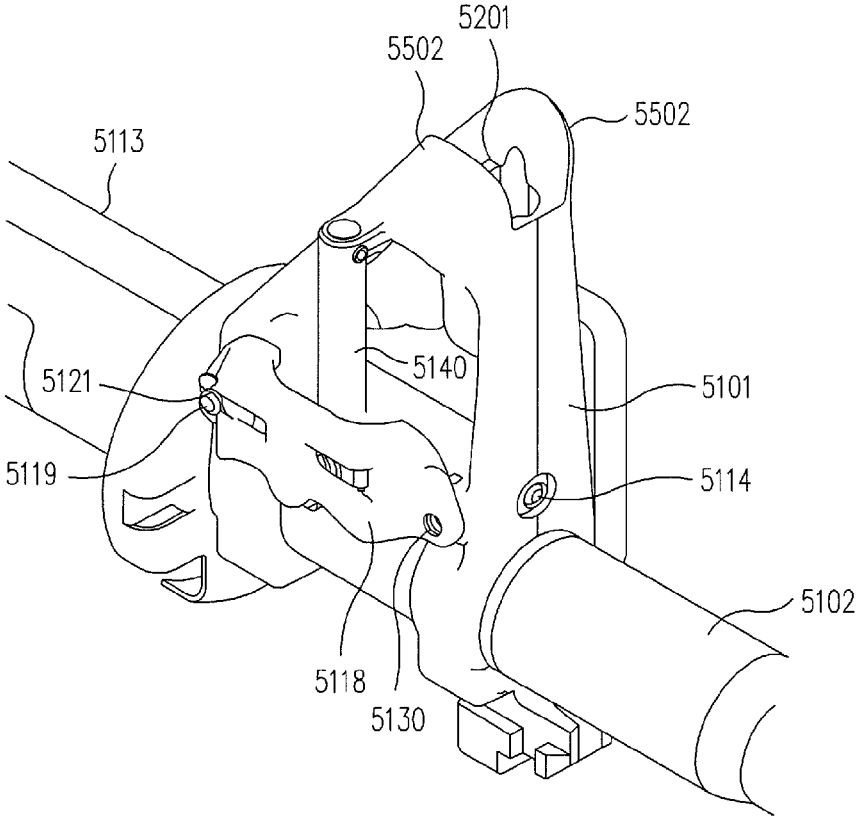
FIG. 41 shows an enlarged view of the gas regulator of FIG. 40, according to an embodiment.
Figure 42:
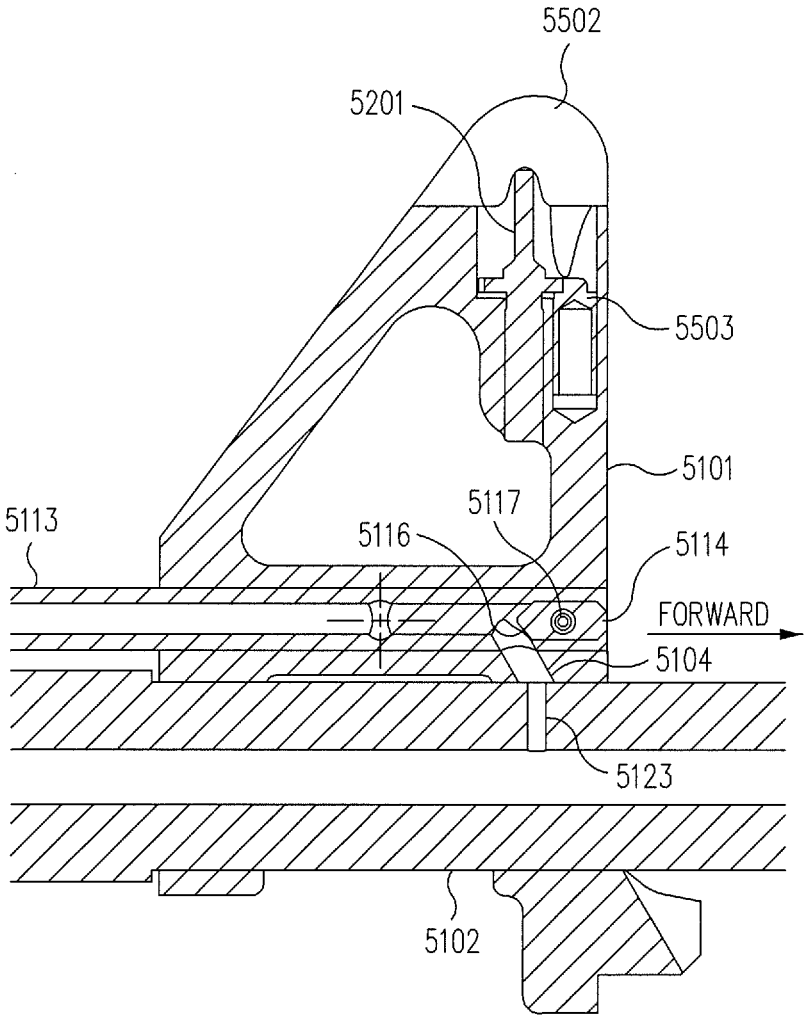
FIG. 42 shows a cross-sectional view of the gas regulator of FIG. 40, according to an embodiment.

Referring now to FIGS. 35-39, a rearwardly positioned gas port 3506 of a contemporary M16/M4 type of firearm can be moved forward, away from the receiver, so as to increase the time between firing a cartridge and cycling the bolt of the firearm and so as to reduce the pressure used to cycle the firearm. The cyclic rate of the firearm can be reduced and stress on components of the firearm can be reduced. In this manner the reliability of the firearm can be substantially enhanced, as discussed herein. FIGS. 35 and 36 show the rearwardly positioned gas port 3506 as it is positioned in a contemporary M4 firearm. FIG. 36 additionally shows the use of a metering block 3601, according to an embodiment. FIGS. 37-39 show the gas port 3703 moved forward as well as the use of the metering block 3601, according to an embodiment.

With particular reference to FIG. 35, the front sight block (also know as a gas block or forging) 3501 and gas tube 3502 of a contemporary firearm, i.e., an M4 carbine, are shown. Firearms of the M16/M4 family are constructed such that the rearwardly positioned gas port 3506 of the barrel 3507 is located proximate the rear band 3504 of the sight block 3501. Gas from the barrel 3507 passes through the rearwardly positioned gas port 3506 and through a gas passage 3503 in the rear band 3504 to reach the gas tube 3502.

With particular reference to FIG. 36, a metering block 3601 (better shown in FIGS. 38 and 39 and which can be the same as or similar to metering plug 1001) can be installed in the front sight block 3501, according to an embodiment. The metering block 3601 can be installed in a firearm that has the gas port 3506 in the standard location, i.e., proximate the rear band 3504. A thick wall gas tube 3510 can additional be used, according to an embodiment.

With reference to FIGS. 37-39, the gas port 3703 can be located further forward as compared to that of a contemporary firearm, according to an embodiment. The thick wall gas tube 3510 can be used. The metering block 3601 can be disposed within the front sight block 3501, such as within that portion of the thick wall gas tube 3510 that is received within the front sight block 3501.

The gas port 3703 can be re-located to this more forward position without moving or changing the shape of the front sight block 3501 or the rear 3504 and front 3505 bands, which surround the barrel 3507 to attach the front sight block 3501 to the barrel 3507. The gas passage 3702 is drilled in the front band 3505 instead of in the rear band 3504. Clearance 3810 can be provided in the lower portion of the front band 3505 either prior to such drilling or by the drilling process itself so as to facilitate such drilling.

The rear band 3504 and the front band 3505 can be formed integrally with the front sight block 3501 (as a single forging or casting, for example). Alternatively, the rear band 3504 and the front band 3505 can be formed separately with respect to the front sight block 3501.

The gas port 3506 (FIG. 35) of a contemporary firearm was originally located in the rear band 3504 when the front sight block 3501 was designed for the longer barrel of the M16 rifle. Then, the same front sight block 3501 and the rearwardly positioned gas port 3506 configuration was used for the 5½ inch shorter carbine barrel. In the carbine, the front sight block 3501 was moved rearward 5½ inches (with respect to the rifle) to maintain the standard distance from the bayonet lug to the muzzle. The rearwardly positioned gas port 3506 was also moved rearward 5½ inches.

The distance from bullet start (firing) to the gas port determines the available pressure and the distance from gas port to the muzzle determines the time that pressure is available, thus the ratio between the two distances determines the impulse (force multiplied by time) of the gas system for the gun. The ratio for an 18½ inch bullet travel length of the rifle barrel is 63/37 (63% from the bullet start to the gas port and 37% from the gas port to the muzzle). The ratio for the 13 inch bullet travel length of the carbine barrel is 47/53. Since the ratio used for the rifle barrel proved to be reliable over decades of service, this reliability suggests that the distance from bullet start to the gas port used on the carbine barrel is two inches shorter than necessary to maintain the same ratio as the rifle.

It thus indicates that the gas port is much closer to the firing chamber (bullet start position) in contemporary M16/M4 firearms than it needs to be.

Placing the gas port 3506 closer to the chamber causes the gas port 3506 (FIG. 35) to be subjected to higher pressure and temperature than necessary. This is because the closer the gas port 3506 is to the chamber, the higher the temperature and pressure to which the gas port 3506 is exposed. Higher temperatures and pressures undesirably cause more aggressive gas port erosion. Additionally, as the carbine's gas system starts unlocking the bolt while there is higher pressure in the chamber (compared to the rifle), the bolt's cam pin hole and locking lugs are undesirably subjected to more stress, which can cause them wear prematurely, bind, and ultimately fail.

Without changing the external dimensions of the front sight block 3501 (these dimensions need to remain the same to accommodate the bayonet, tripod, barrel launched grenade and separate grenade launcher) a full two inch correction isn't feasible. However, it is feasible to reposition the gas port 1.23 inches further forward as discussed herein, thus gaining substantial benefit. Thus, by moving the barrel's gas port and the gas block's passageway hole from the rear band 1.23 inches forward into the front band 3505, problems associated with contemporary firearms can be substantially mitigated.

A bore 3712 can be formed in the front sight block 3501 for receiving the gas tube 3510. The bore 3712 can extend completely through the front sight block 3501.

As best shown in FIGS. 38 and 39, the metering block 3601 can comprise an inlet 3804 (FIG. 39) and a bore 3801. The inlet 3804 and/or the bore 3801 are sized and configured to provide the desire gas metering function. That is, the inlet 3804, the bore 3801, or both are configured to allow a desired amount of gas to flow from the gas port 3703 to the gas tube 3510. The inlet 3804 and/or the bore 3801 can define a fixed, calibrated orifice for determining the amount of gas flow through the metering block 3601. Thus, the amount of gas used to cycle the firearm can be better controlled, e.g., can be fine tuned.

An opening 3803 (FIG. 39) can be formed in the gas tube 3791 to facilitate gas flow from the gas passage 3702 to the metering block 3601. A hole 3802 can be provided through the metering block 3601 and/or the gas tube 3510 to facilitate attachment, e.g., pinning, of the gas tube 3510 and/or the metering block 3601 to the front sight block 3501.

As discussed herein, gas operated firearms utilize an operating cycle that is powered by high temperature and high pressure gas produced by the combustion of propellant from a fired cartridge. A small portion of this gas is tapped through a hole or gas port in the barrel and is diverted through a passage or tube to push on a piston and thereby cause internal parts, e.g., a bolt carrier assembly, of the firearm move rearward according to a multi-stepped operating cycle. The gas actuation phase of the operating cycle is short compared to the overall length of the operating cycle. Thus, adequate rearward movement of the internal parts of the firearm is somewhat dependent on inertia. A spring that is compressed by the parts as they move rearward returns the parts to their original forward position.

In general, to provide reliable operation, the gas flow in a gas operated firearm should be regulated to provide an operating cycle of the firearm that is within a certain or optimal range, e.g., a range of operating cycle speeds. If the operating cycle is too slow (such as when there is insufficient gas flow), then a rearward part of the operating cycle may fail to be completed and the firearm may not be ready to fire again when needed.

If the operating cycle is too fast (such as when there is excessive gas flow), then even more types of malfunctions can occur as compared to when the operating cycle is too slow. High speed cycling can cause malfunctions, excessive wear, or can make the firearm inoperative. For example, the firearm can jam at an inopportune time, such as during battlefield use.

When properly designed and new, a gas operated firearm's gas flow is typically properly regulated for reliable function. Thus, a new gas operated firearm generally cycles within a speed range that is appropriate for reliable operation. Generally, no adjustment to the gas flow is needed for a properly designed, new gas operated firearm.

However, the high temperature and high pressure operating gas from fired cartridges is erosive by nature. Grains of still burning propellant add to the erosion. As the gas flows through the internal passages inside of the firearm to provide power for the operating cycle, the gas wears down metal surfaces, rounding sharp corners and/or eroding depressions into the metal. The closer surfaces are to the source of heat and pressure, e.g., the chamber, the greater this erosive effect.

Also, rapid successive firing heats the barrel, thereby weakening the steel and making it even more susceptible to gas erosion. Recently, reliable, high capacity magazines (such as SureFire 60 and 100 round magazines) have become widely available, thus allowing unprecedented amounts of ammunition to be fired though such firearms in a short time. Such rapid firing tends to compound the detrimental effects of gas erosion.

Eroded gas passages tend to allow the gas to flow more readily therethrough. This increases the volume of gas passing through the system, thereby undesirably speeding up the operating cycle. As the erosion continues to increase, so does the operating cycle speed of the gas operated firearm.

When sped up, moving parts of the gas operated firearm may no longer function as intended. A component of the firearm may bounce off of angled surfaces that the component should cause to move, or may bounce off of surfaces that the component should stop against, thus causing timing related malfunctions.

It is known in the art that when the speed of a moving mass is doubled, its impact force increases by 400%. As these moving components strike harder and harder against their stopping surfaces, then battering, breakage, and recoil increases. Also, the centerline of the barrel is thrown more violently upwards during firing so as to ruin aiming of the firearm and thus causes ammunition to be wasted.

Thus, as a gas operated firearm undergoes more use; the likelihood of needing an adjustment to the gas flow becomes more likely. If such an adjustment is not made, then the firearm is likely to malfunction eventually.

Figure 43:
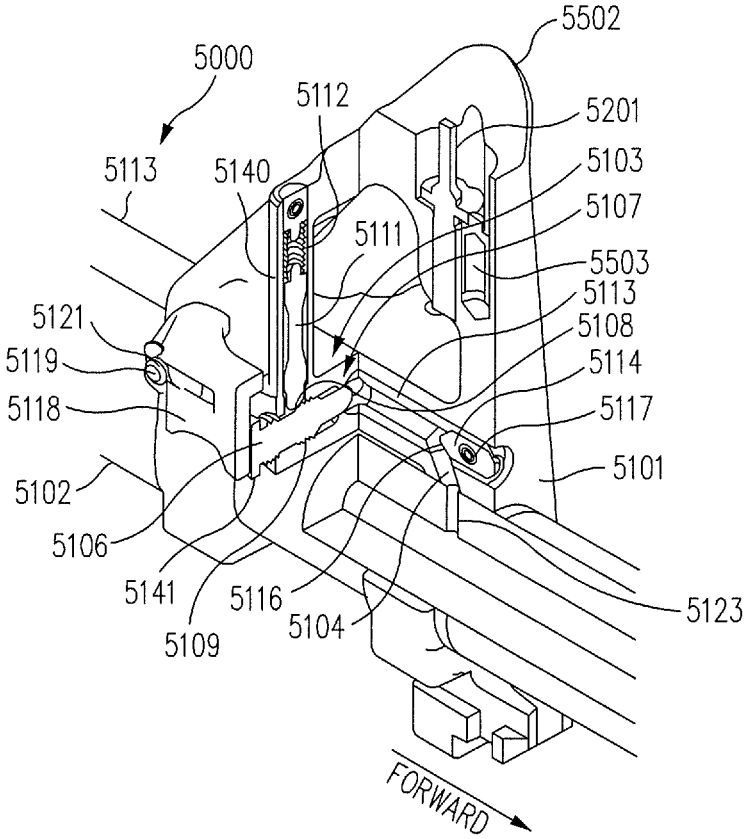
FIG. 43 shows a cut away view of the gas regulator of FIG. 40, according to an embodiment.
Figure 44:
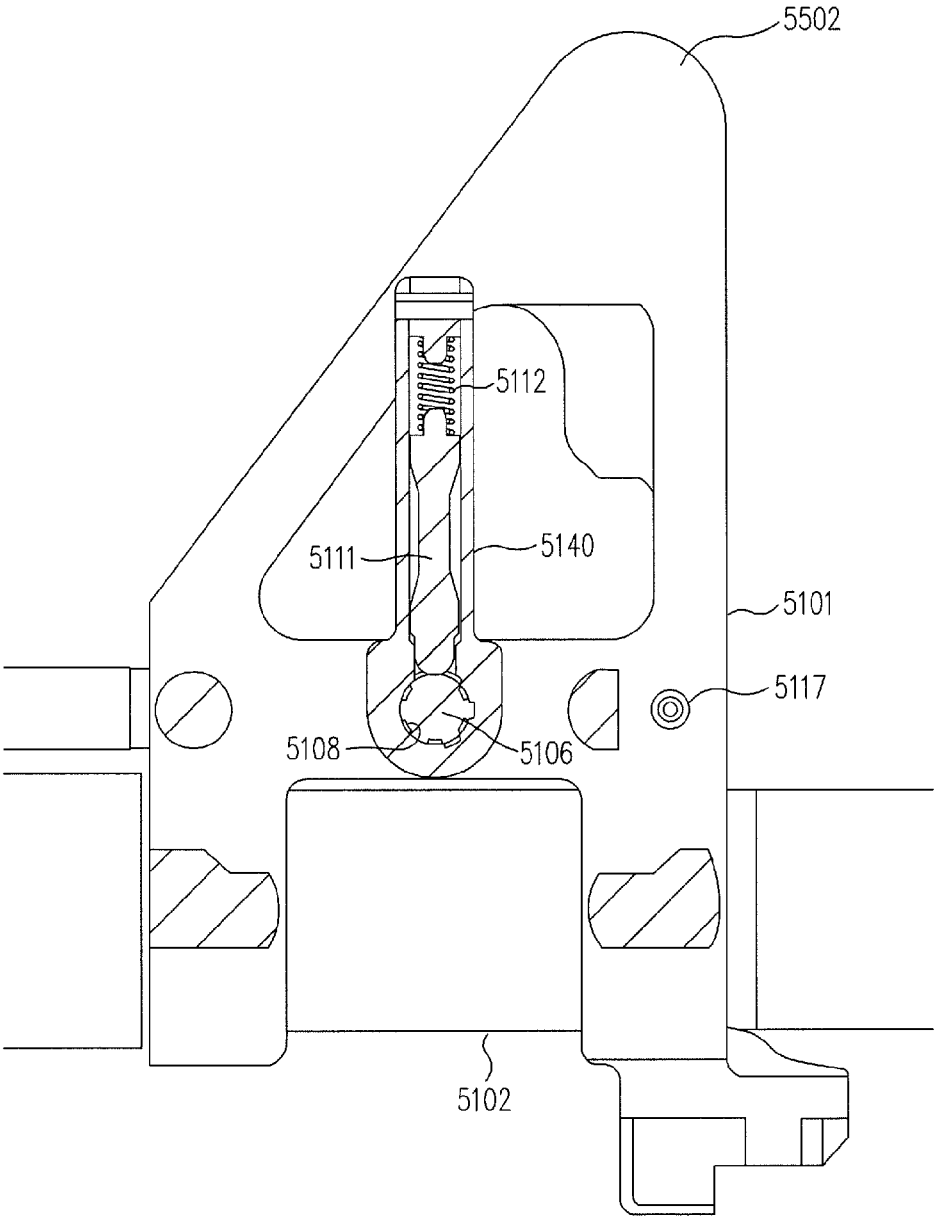
FIG. 44 shows a partial cross-sectional view of the gas regulator of FIG. 40, according to an embodiment.

Referring now to FIGS. 40-52, a gas regulator system for a firearm 5000 (FIG. 43) is shown, according to an embodiment. The gas regulator system is suitable for use with gas operated firearms, such as the M16 rifle and M4 carbine. The gas regulator system can be adapted for use with other gas operated firearms.

With particular reference to FIGS. 40-43, the gas regulator system can comprise a gas regulator block 5101 that can be mounted to a barrel 5102 of the firearm 5000. A gas regulator 5103 can comprise an adjustment screw 5106 that at least partially defines a needle valve 5107. The adjustment screw 5106 can have a hexagonal head 5141. A gas passage 5104 formed in the gas regulator block 5101 can receive combustion gas from a fired cartridge via gas port 5123 of the barrel 5102. A plug 5114 can redirect or deflect the gas from a generally upward (and partially rearward) direction to a generally rearward direction and into a gas tube 5113. The tube 5113 can have has a wall thickness of between 0.045 inch and 0.063 inch. A slanted surface 5116 can be formed on the plug 5114 to enhance the deflection of the gas from the gas port 5104 into the tube 5113. A cross pin 5117 can attach the gas regulator block 5101, the plug 5114, and the tube 5113 together.

The adjustment screw 5106 can comprise a threaded portion 5109 having detents or troughs 5108 (better shown in FIG. 52) formed therein. A plunger 5111 can be biased downwardly by a spring 5112 to engage the troughs 5108. The spring 5112 and the plunger 5111 can be slidably disposed out side of the gas regulator block 5101, such as within a tower 5140 that extends next to the gas regulator block 5101.

According to an embodiment, the adjusting screw 5106 can comprise a stem 5151. The stem 5151 can extend beyond the threaded portion 5109. At least one cutting groove 5152 can be formed at an inward end of the threaded portion 5109 where the threaded portion 5109 joins the stem 5151. The cutting grooves 5152 can be configured to remove carbon deposits that have accumulated in a cavity or a tube, e.g., the tube 5113, which is configured to extend from the gas regulator block to a bolt carrier assembly of the firearm. The cavity can be formed between an end of the threaded portion 5109 and a stem hole in the gas regulator block 5101. The cutting can occur when the adjusting screw 5106 is adjusted for removal.

A cover 5118 can cover the adjustment screw 5106. The cover 5118 can be rotatably attached to the gas regulator block 5101 via a post 5119. The cover 5118 can be held onto the post 5119 via a snap ring 5121. The cover 5118 can be held in the closed position, wherein the cover 5118 covers the adjustment screw 5106, via a hook 5122 (FIGS. 48 and 51) that engages a portion of the gas regulator block 5101 and via the cross pin 5117. The cross pin 5117 can be received within a hole 5130 formed in the cover 5118 and can be pushed into the gas regulator block 5101 to allow the hook 5122 to disengage the gas regulator block 5101 and to allow the cover 5118 to rotate and thus expose the adjustment screw 5106.

According to an embodiment, the size, shape, and location of the gas regulator block 5101 can be substantially maintained with respect to a contemporary gas regulator block. In this manner, commonly available parts and accessories such as bipods, bayonets, and grenade launchers can be used with the disclosed gas regulator block 5101. Surfaces on the gas regulator block 5101 may or may not be used as the front sight mounting system. For example, the gas regulator block 5101 can comprise a front sight 5201. The front sight 5201 can be adjustable for bullet drop compensation.

According to an embodiment, a gas system that resists erosion, manages heat buildup, as well as provides more accurate and safer operation, is provided. Adjustable regulation of the gas system as it erodes is also provided, thereby allowing the operator to desirably maintain control over the operating speed of the weapon.

According to an embodiment, more effective heat management is provided by the gas regulator block 5101, which is mounted on the barrel 5102 of the gas operated firearm 5000. The gas port 5123 leading from the barrel 5102 into the gas regulator block 5101 can be moved as far forward in the gas regulator block 5101 as practical. Operating gas closer to the front of the barrel 5102 (and thus further from the chamber where combustion of the propellant mostly occurs), is lower and more consistent in pressure and temperature. The gas which flows through a more forward located gas passage 5104 will cause less erosion and will tend to provide a more consistent operating cycle. For example, a more consistent operating cycle time can be provided.

Besides being moved forward, the gas passage 5104 in the gas regulator block 5101 can be drilled at a rearward angle to help smooth the gas flow as it turns sharply into the gas tube 5113. The tube 5113 can be a thin wall metal tube mounted at least partially within the gas regulator block 5101, as discussed herein. When the gas reaches the tube 5113, it can be diverted rearward, by the plug 5114. The plug 5114 can be permanently mounted in the tube 5113, for example. One or more surfaces 5116 formed on the plug 5114 can be shaped to enhance gas flow rearward, from the gas passage 5104 into the tube 5113. The cross pin 5117 can extend through the gas regulator block 5101, through the tube 5113, and through the plug 5114, so as to hold the gas regulator block 5101, the tube 5113, and the plug 5114 together.

According to an embodiment, operating gas is routed from the barrel 5102 and through the gas regulator block 5101. The tube 5113 can extend behind the gas regulator block 5101, to conduct the gas rearward, to the bolt carrier assembly where the gas unlocks and moves the bolt and bolt carrier.

By moving the gas passage 5104 forward, the area of the gas regulator block 5101 surrounding the thin wall gas tube 5113 is lengthened. This area is also wider and taller. The resulting greater mass provides a larger heat sink for the tube 5113. The larger heat sink better cools the hot gases from fired cartridges. If desired, heat radiating fins could be formed in this area on the outside of the gas regulator block 5101 to further draw heat away from the tube 5113. Keeping the tube 5113 from over-heating during rapid firing is important. Heat has been known to warp gas tubes to the point of failure. Thus, the gas regulator system can both regulate the amount of gas and can cool the gas so as to provide more reliable operation of the firearm, maintain a desired cyclic rate of the firearm, and prevent damage to the firearm.

Proximate the center of the gas regulator block 5101 and intersecting the tube 5113 can be the gas regulator adjustment screw 5106. The gas regulator adjustment screw 5106 partially defines and functions as the needle valve 5107. By screwing the adjustment screw 5106 in and out, the tip of the adjustment screw 5106 affects the flow of operating gas flowing through the tube 5113. Screwing the adjustment screw 5106 to the full forward position tends to block all gas flow. Screwing the adjustment screw 5106 out to its rear stop can provide more gas flow than would ever be needed. The adjustment screw 5106 can be made of heat resistant material and/or can be coated with heat resistant material. The adjustment screw 5106 can be a hexagonal driving head screw, although other configurations can be used.

Rotational movement of the gas adjustment screw 5106 can be controlled or limited by a spring tensioned detent. For example, indexing troughs 5108 can be formed in the threaded portion 5109 of the screw 5106 and the plunger 5111 can apply force, via the spring 5112, to these troughs 5108 to facilitate accurate adjustment of the screw 5106 and to inhibit unintended rotation of the screw 5106. Accurate adjustment of the screw 5106 can be provided by counting the clicks caused by the plunger 5111 as the plunger 5111 sequentially engages the troughs 5108 when the screw 5106 is turned. Counting the clicks from full engagement (a fully screwed in position) of the screw 5106 can provide an indication of how far out the screw 5106 has been turned and how much gas can be expected to flow, for example.

This stepped, incremental adjustment of the gas regulator 5103 can allow the user to reduce the operating cycle speed of the firearm 5000 back down to a correct rate as erosion of the gas port 5123 speeds up the operating cycle. The firearm 5000 can also be tuned via the screw 5106 to function correctly with ammunition loaded to different power levels, e.g., with different powder loads and/or bullet weights.

Adjustment can also be made when the weapon is fired with a sound suppression device attached to the barrel 5102 to account for the difference in gas pressure within the barrel 5102 caused by the sound suppression device. The use of a sound suppression device is known to speed up the operating cycle of a firearm due to the increase of pressure with the barrel 5102 caused thereby.

When the firearm 5000 operates at the lowest speed, e.g., the longest operating cycle, that still provides correct functioning of the firearm 5000, then recoil force is at its lowest. Shot to shot firing is optimized, as the barrel does not tend to rise above the line of sight as much during recoil, thereby making rapid fire more accurate. This serves to conserve ammunition, reduce heat, and reduce wear on the whole weapon system (which can include auxiliary devices such as laser sights, flashlights, grenade launchers, and the like).

The spring 5112 provided for detent tension of the plunger 5111 in the troughs 5108 of the screw 5106 can be mounted at the far side of a long plunger 5111, as remotely as practical from the gas regulator adjustment screw 5106. The plunger 5111 and spring 5112 can be mounted within the projecting tower 5140, such as along side of the gas regulator block 5101. Such mounting can inhibit the intense heat generated by rapid fire shooting from transferring into the spring 5112, which could cause the spring 5112 to lose some or all of its spring tension.

To correctly adjust the gas regulator 5103, the adjustment screw 5106 of the needle valve 5107 should be screwed all the way inward, then a magazine loaded with one round of the desired ammunition can be installed in the firearm 5000 and the gun fired semi auto. Then the screw 5106 can be unscrewed one click after each one of several successive shots are fired (each time with a single round in the magazine) until the weapon's last round device catches the bolt. The screw 5106 can be unscrewed two more clicks (to assure adequate gas flow), where it can remain with the gun cycling correctly until gas port erosion, a change in ammunition, or some other factor causes the gas regulator to require readjustment.

Outboard of the screw 5106 can be a cover 5118. The cover 5118 can allows the screw 5106 to be accessible for adjustment, but can also limit how far the screw 5106 can be backed out of the gas regulator block 5101, so that the screw 5106 can always maintain adequate thread engagement during firing to keep it safely engaged with the gas regulator block 5101.

The gas regulator cover 5118 can be held securely in place on the gas regulator block 5101. At the rear the cover 5118 can be held on the post 5119 by the snap ring 5121. At the front the cover 5118 can be held by an interlocking hook 5122 and cross pin 5117. The hook 5122 can be disengaged by rotating the cover 5118. The cover 5118 can rotate about the centerline of the post 5119 and the snap ring 5121. The cover 5118 cannot be readily rotated out of the way.

The same cross pin 5117 that holds the gas tube 5113 into the gas regulator block 5101 must be partially driven inward to allow the cover 5118 to be rotated up and thereby expose the adjusting screw 5106. Thus, the operator can adjust the gas flow (to vary the operating cycle speed), but can not easily remove the cover 5118 from the gas regulator block 5101. Removing the cover 5118 allows the gas regulator screw 5106 to be removed from the gas regulator block 5101, if need be.

According to an embodiment, the gas regulator block 5101 can include features that act as a front sight, similar to that of the contemporary M16 rifle and M4 carbine. The sight protection ears 5502 on the gas regulator block 5101 have been raised. Features have also been made so that the staff of the front sight 5201 and an adjustment plunger 5503 can move more deeply downwards. By installing a taller staff of the front sight 5201, a higher line of sight can be attained. This was done to provide an improvement in the M16 Rifles and M4 Carbines with Picatinney flat top rails over the receiver with a detachable receiver mounted carrying handle. The standard detachable handle has inadequate clearance under it for a hand to pass through it. With a higher front sight and rear sight adjusted higher, a detachable carry handle with correct handle height for hand clearance can be installed.

Figure 45:
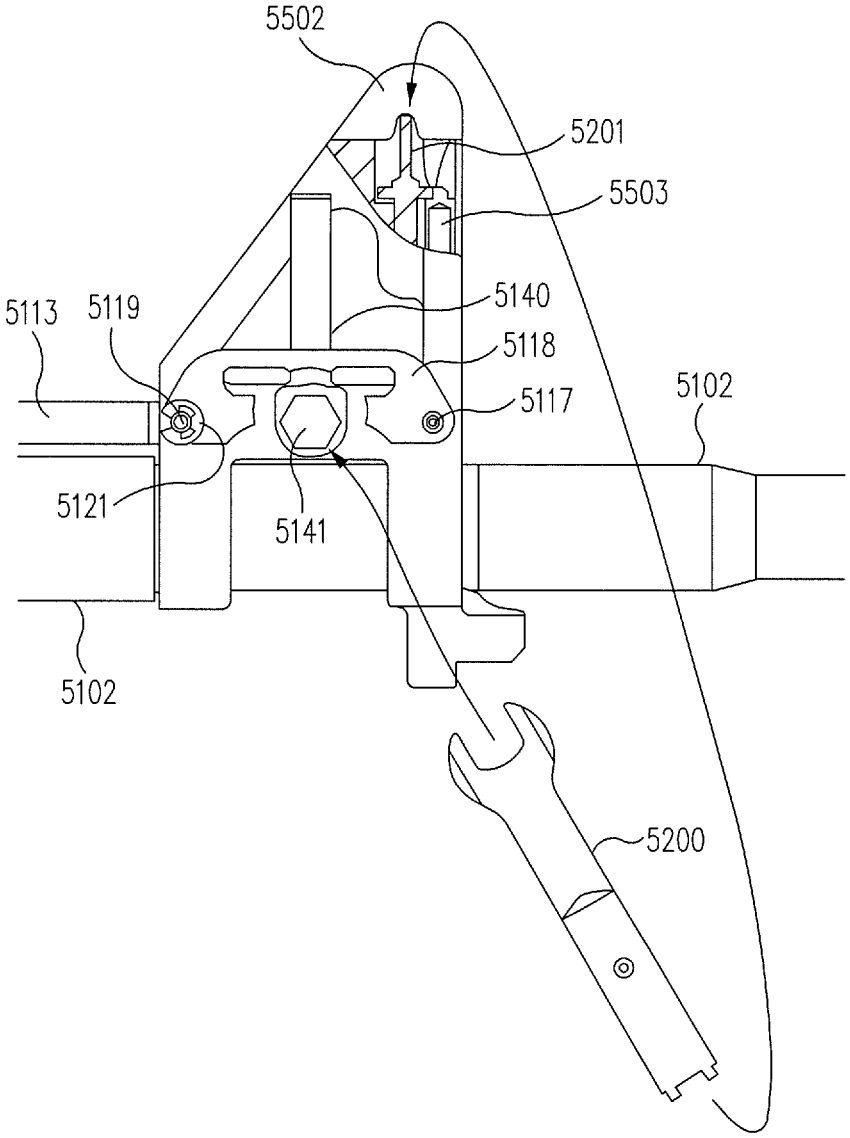
FIG. 45 shows a partial cross-sectional view of the gas regulator of FIG. 40, and shows use of a gas flow and sight adjustment tool, according to an embodiment.
Figure 46:
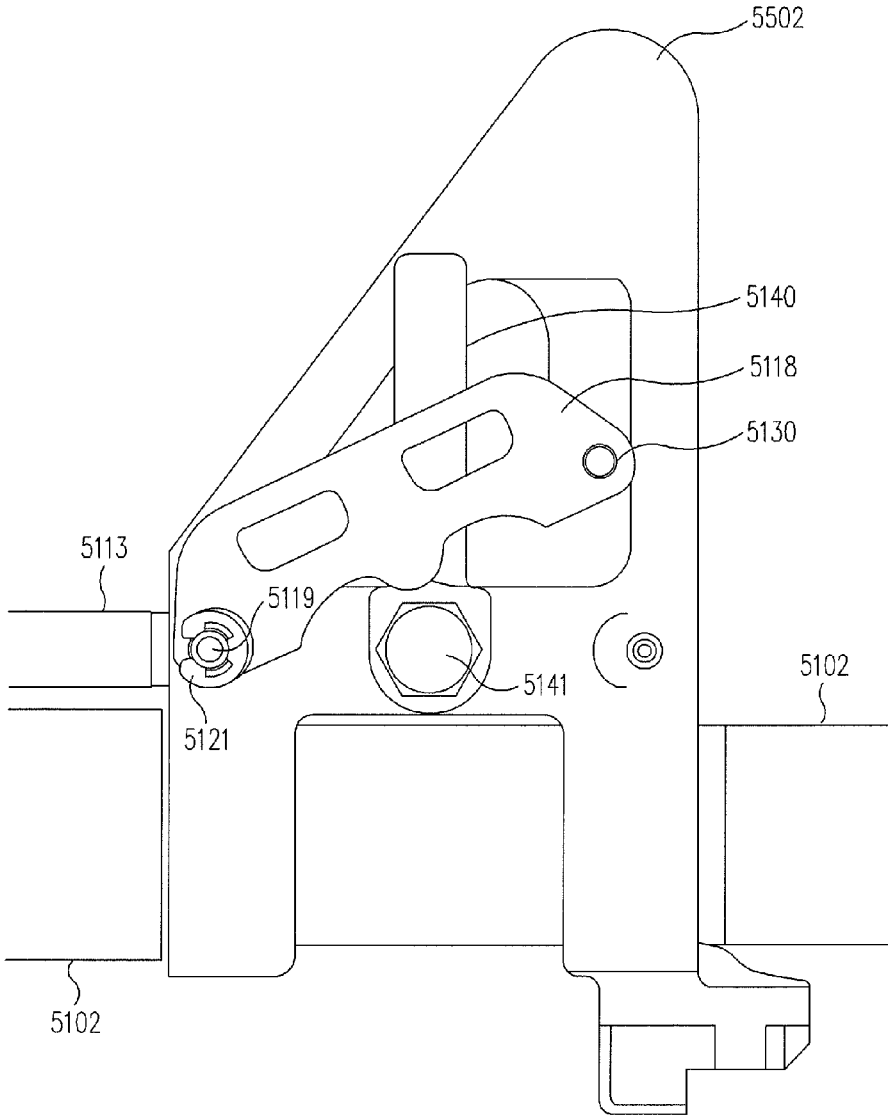
FIG. 46 shows the gas regulator of FIG. 40 with the cover rotated, according to an embodiment.
Figure 47:
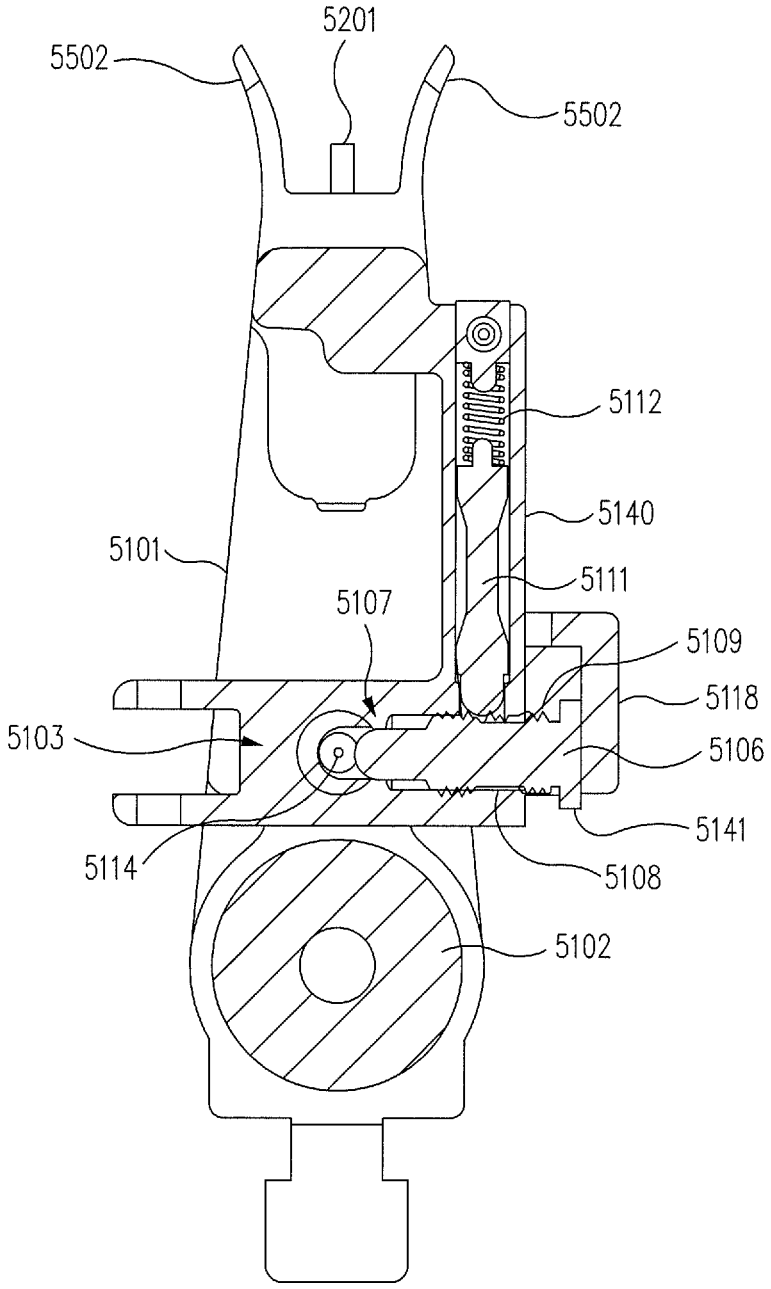
FIG. 47 shows a partial cross-sectional view of the gas regulator of FIG. 40, according to an embodiment.
Figure 48:
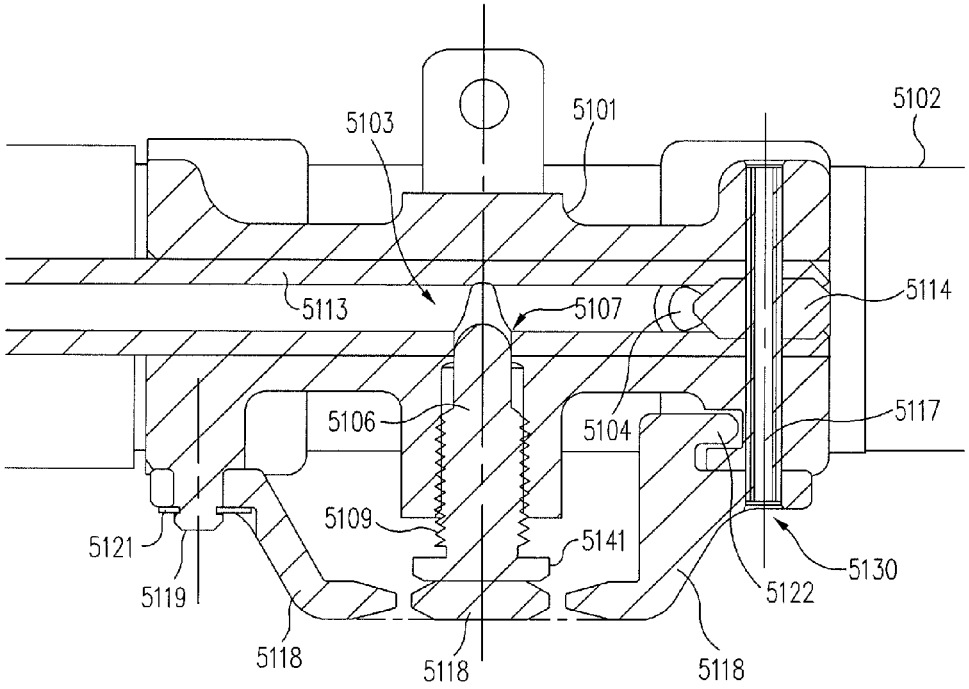
FIG. 48 shows a partial cross-sectional view of the gas regulator of FIG. 40, according to an embodiment.
Figure 49:
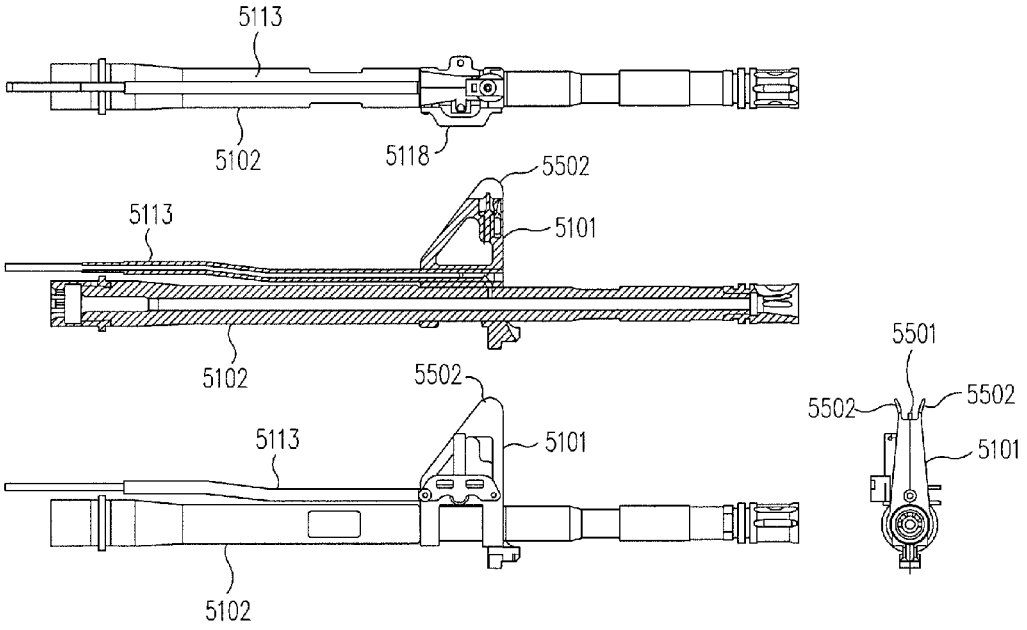
FIG. 49 includes various views of the gas regulator mounted on the barrel, according to an embodiment.
Figure 50:
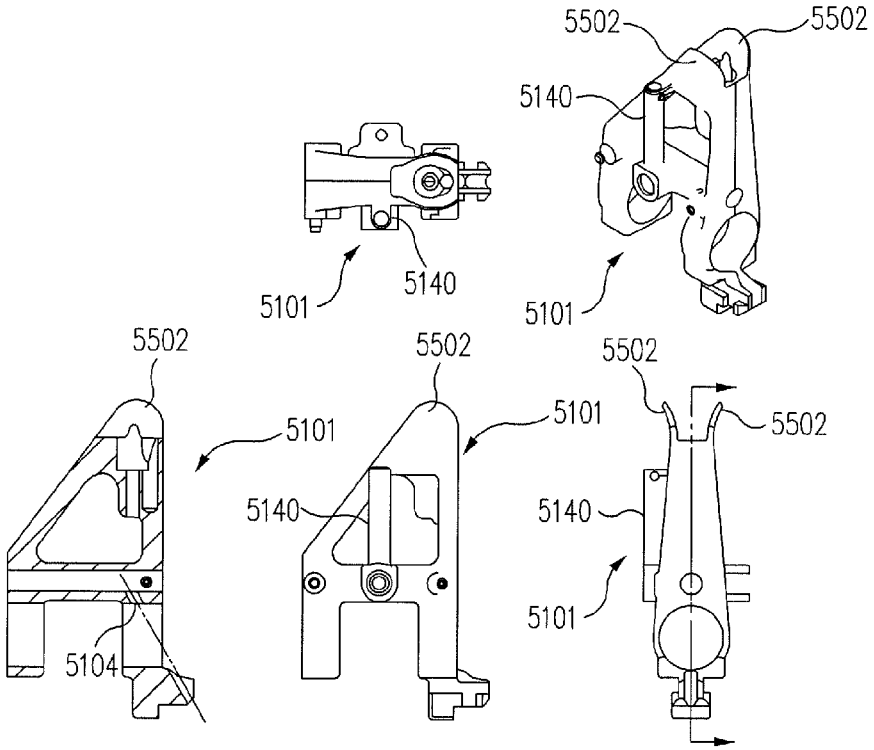
FIG. 50 includes various views of the gas regulator, according to an embodiment.
Figure 51:
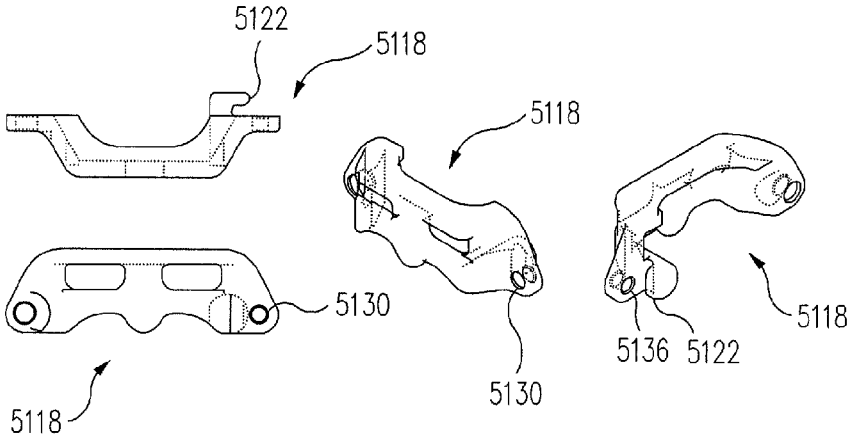
FIG. 51 includes various views of the cover, according to an embodiment.
Figure 52:
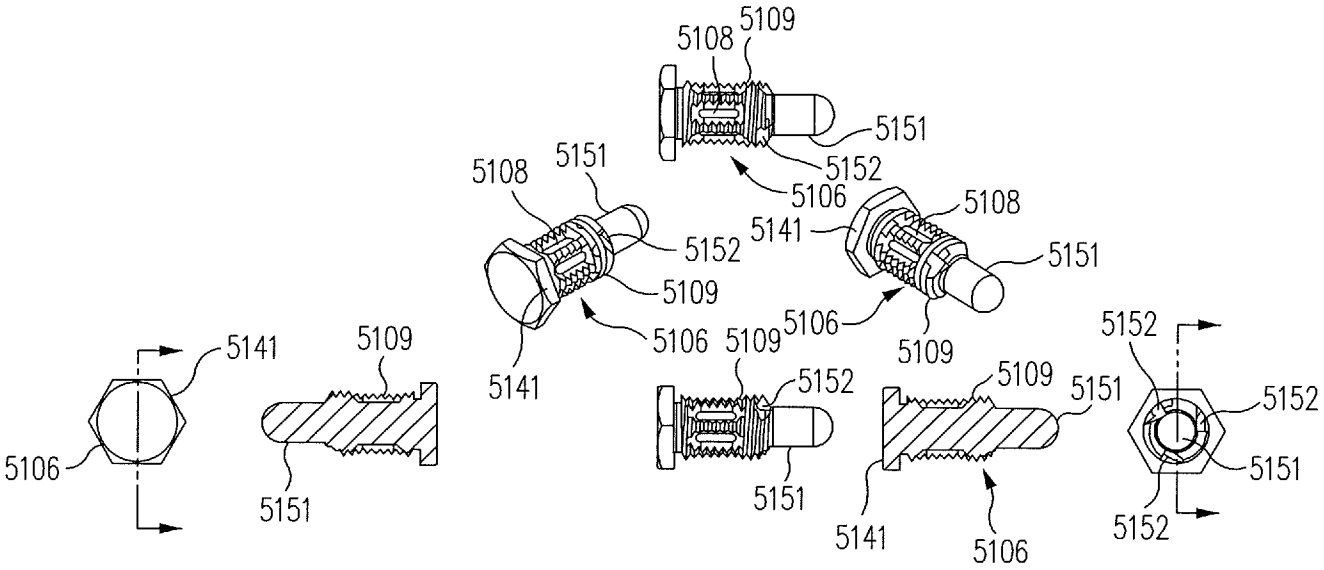
FIG. 52 includes various views of the adjustment screw, according to an embodiment.

With particular reference to FIG. 45, a wrench or tool 5200 can be provided. The tool 5200 can be used to both adjust gas flow and adjust bullet drop for the front sight 5201.

Embodiments described above illustrate, but do not limit, the invention. It should also be understood that numerous modifications and variations are possible in accordance with the principles of the present invention. Accordingly, the scope of the invention is defined only by the following claims.

The invention claimed is:

1. A device comprising:

a gas regulator block configured to mount to a barrel of a firearm;

a gas regulator disposed substantially within the gas regulator block and configured to adjustably vary an amount of gas flow through the gas regulator block;

a cover configured to rotate from a closed position in which the cover covers a portion of the gas regulator block to limit adjustment of the amount of gas flow to an open position in which the cover uncovers the portion of the gas regulator block to facilitate removal of a gas regulator screw;

a gas passage formed in the gas regulator block, the gas passage being configured to communicate gas from a gas port in the barrel to the gas regulator, wherein the device comprises the barrel to form the firearm;

a tube configured to extend from the gas regulator block to a bolt carrier assembly of the firearm; and a plug disposed in the gas regulator block and configured to divert gas into the tube; wherein the gas regulator screw intersects the tube.

2. The device as recited by claim 1, wherein the gas regulator comprises the gas regulator screw and wherein the gas regulator screw at least partially defines a needle valve for varying gas flow through the gas regulator block.

3. The device as recited by claim 2, wherein, in the closed position, the cover allows limited adjustment of the gas regulator screw.

4. The device as recited by claim 2, wherein, in the closed position, the cover is configured to limit outward movement of the gas regulator screw.

5. The device as recited by claim 2, wherein a rear of the cover is held to a post of the gas regulator block via a snap ring and a front of the cover is held to the gas regulator block via an interlocking hook and a cross pin such that the cover is releasable from the hook by moving the cross pin and the cover is rotatable about the post to provide access to the gas regulator screw.

6. The device as recited by claim 2, wherein the gas regulator screw comprises:

a stem;

threads; and at least one cutting groove formed at an inward end of the threads where the threads join the stem, such that the at least one cutting groove is configured to remove carbon deposits accumulated in at least one of a cavity and the tube configured to extend from the gas regulator block to the bolt carrier assembly of the firearm, the cavity being formed between an end of the threads and a stem hole in the gas regulator block and the cutting occurring when the screw is adjusted for removal.

7. The device as recited by claim 1, wherein the gas regulator has troughs formed in a threaded portion thereof and wherein the gas regulator further comprises a plunger and a spring for biasing the plunger to index the troughs.

8. The device as recited by claim 7, wherein the plunger and the spring are disposed outside of the gas regulator block to mitigate heat transfer from the gas regulator block to the plunger and the spring.

9. The device as recited by claim 1, wherein a beginning of the gas passage is positioned in a forward ring of a two ring gas regulator block.

10. The device as recited by claim 1, wherein the gas port in the barrel is disposed proximate a forward portion of the gas regulator block, and wherein the gas regulator screw is disposed proximate a center of the gas regulator block, so that the gas regulator screw and a gas passageway between the gas port and the gas regulator screw are surrounded by material of the gas regulator block that acts as a heat sink arranged to absorb heat that might otherwise damage the device.

11. The device as recited by claim 1, wherein the gas passage is formed at an angle with respect to a longitudinal axis of the barrel when the gas regulator block is attached to the barrel.

12. The device as recited by claim 1, wherein the gas passage is configured to cause gas to flow rearwardly from the barrel to the gas regulator.

13. The device as recited by claim 1, wherein the gas passage is angled rearwardly from the barrel to the gas regulator.

14. The device as recited by claim 13, wherein the plug has a surface positioned at least partially over the gas passage that is configured to enhance rearward gas flow.

15. The device as recited by claim 13, further comprising a cross pin that extends through the gas regulator block, the tube, and the plug to hold the gas regulator block, the tube, and the plug together.

16. The device as recited by claim 1, wherein the tube is a thin walled tube.

17. The device as recited by claim 1, wherein the plug is permanently mounted in the tube.

18. A method of operating the device as recited by claim 1, the method comprising:

rotating the cover from the open position to the closed position to cover the adjustment screw; and adjusting the amount of gas flow by turning the adjustment screw with the cover in the closed position.

19. A system comprising:

a firearm having a barrel with a gas port formed therein;

a gas regulator block mounted to the barrel;

a gas regulator disposed substantially within the gas regulator block and configured to vary an amount of gas flow through the gas regulator block;

a gas regulating screw configured to be disposed in an opening in the gas regulator block;

a cover configured to cover the opening and the gas regulating screw and to limit how far the gas regulating screw can be unscrewed from the gas regulator block; and a gas passage formed in the gas regulator block, the gas passage being configured to communicate gas from the gas port in the barrel to the gas regulator; and a tube configured to extend from the gas regulator block to a bolt carrier assembly of the firearm, wherein the gas regulating screw intersects the tube.

20. The system of claim 19, wherein the cover is configured to rotate from a closed position to an open position.

21. A method comprising:

rotating a cover attached to a gas regulator block of a firearm to substantially expose an adjustment screw;

turning the adjustment screw to vary an amount of gas used to cycle the firearm; thereby the speed at which a firearm operates;

wherein a spring urges a plunger into troughs of the adjustment screw to index the adjustment screw as the adjustment screw is turned; and prior to the rotating, unhooking a portion of the cover from the gas regulator block, while an additional portion of the cover remains attached to the gas regulator block.

22. The method as recited by claim 21, wherein the unhooking comprises pushing a cross pin into the gas regulator block to allow a hook to disengage the gas regulator block.

23. The method as recited by claim 21, further comprising rotating the cover to a closed position to prevent removal of the adjustment screw.

24. A firearm, comprising:

a barrel with a gas port disposed therein;

a gas regulator block coupled to the barrel;

a gas regulator disposed substantially within the gas regulator block and configured to vary an amount of gas flow through the gas regulator block;

a gas passage disposed in the gas regulator block, the gas passage being configured to communicate gas from the gas port in the barrel to the gas regulator; and a tube configured to extend from the gas regulator block to a bolt carrier assembly of the firearm, wherein the gas regulator comprises an adjustment screw that intersects the tube.

25. The firearm as recited by claim 24, wherein the adjustment screw further comprises a cutting groove configured to remove carbon deposits.

26. The firearm as recited by claim 24, further comprising:

a post; and a cover configured to rotate about the post to provide access to the adjustment screw.

27. The firearm as recited by claim 24, further comprising a plug disposed in the gas regulator block and configured to divert gas into the tube, wherein a portion of the plug extends over the gas passage.

* * * * *

UNITED STATES PATENT AND TRADEMARK OFFICE

CERTIFICATE OF CORRECTION

PATENT NO. : 8,973,483 B2
APPLICATION NO. : 13/829464
DATED : March 10, 2015
INVENTOR(S) : Leroy James Sullivan It is certified that error appears in the above-identified patent and that said Letters Patent is hereby corrected as shown below:

In the Specification

Column 15, line 21: Replace “unlocking earn surface” with --unlocking cam surface--

Column 16, line 18: Replace “faulted” with --formed--

Signed and Sealed this
Thirtieth Day of June, 2015

Michelle K. Lee

Michelle K. Lee
*Director of the United States Patent and Trademark Office*